US006138461A

United States Patent [19]

Park et al.

[11] Patent Number: 6,138,461

[45] Date of Patent: Oct. 31, 2000

[54] METHOD AND APPARATUS FOR PREDICTING POWER CONSUMPTION OF REFRIGERATOR HAVING DEFROSTING HEATER

[75] Inventors: Yong Jong Park, Seongnam; Hak Gyun Bae, Andong, both of Rep. of Korea

[73] Assignee: Samsung Electronics Co., Ltd., Suwon, Rep. of Korea

[21] Appl. No.: 09/408,513

[22] Filed: Sep. 30, 1999

[30] Foreign Application Priority Data

Oct. 1, 1998 [KR] Rep. of Korea ..... 98-41467
Oct. 1, 1998 [KR] Rep. of Korea ..... 98-41468

[51] Int. Cl.[7] ..... F25B 49/02

[52] U.S. Cl. ..... 62/126; 62/129; 702/182

[58] Field of Search ..... 62/125, 126, 127, 62/128, 129, 130, 230, 151, 155, 156, 234; 702/182; 236/94; 165/11.1

[56] References Cited

U.S. PATENT DOCUMENTS 3,995,686 12/1976 Laube ..... 62/125 X
4,186,563 2/1980 Schulze, Sr. ..... 62/126
4,432,232 2/1984 Brantley et al. ..... 62/129 X
4,510,576 4/1985 MacArthur et al. ..... 702/182

*Primary Examiner*—Harry B. Tanner
*Attorney, Agent, or Firm*—Larson & Taylor, PLC

[57] ABSTRACT

A power consumption prediction method and apparatus for a refrigerator having a defrosting heater is provided. In the power consumption prediction method, a defrosting timer cycle expressed as a cumulative value of an operation time of a compressor is set. The defrosting heater is activated to perform forced defrosting. The compressor is activated so that cooling cycles are completed several times. A defrosting time, a pause time and an operation time of the compressor and the energy consumed during each time are respectively detected. Based on the detected results, a unit run cycle of the refrigerator corresponding to the defrosting timer cycle is estimated. The energy consumption for a predetermined interval of time is estimated. Accordingly, the test time for power consumption prediction for the refrigerator can be shortened.

32 Claims, 11 Drawing Sheets

| NAMES OF MODELS | | KS REGULATIONS (kwh/MON) | TIME MEASURED (HR) | MEASUREMENT BY THE PRESENT INVENTION (kwh/MON) | TIME OF TEST (min) | ACCURACY (%) |
|---|---|---|---|---|---|---|
| MODEL 1 | 1st | 79.59 | 72 (4320min) | 79.25 | 337 | 99.57 |
| | 2nd | 84.24 | | 84.72 | 319 | 100.57 |
| MODEL 2 | 1st | 52.62 | 24 (1440min) | 52.28 | 360 | 99.35 |
| | 2nd | 49.04 | | 49.24 | 365 | 100.40 |
| | 3rd | 51.19 | | 51.40 | 370 | 100.41 |
| MODEL 3 | 1st | 54.51 | 24 (1440min) | 54.61 | 290 | 100.18 |
| | 2nd | 55.14 | | 54.56 | 289 | 98.95 |
| MODEL 4 | 1st | 47.85 | 48 (2880min) | 48.00 | 271 | 100.31 |
| | 2nd | 44.12 | | 44.01 | 324 | 99.75 |
| | 3rd | 46.84 | | 46.90 | 255 | 100.13 |
| AVERAGE | | | | | 318 | 99.96 |

METHOD AND APPARATUS FOR PREDICTING POWER CONSUMPTION OF REFRIGERATOR HAVING DEFROSTING HEATER

BACKGROUND OF THE INVENTION

1. Field of the Invention

The present invention relates to a method and an apparatus for predicting power consumption of a refrigerator having a defrosting heater, and more particularly, to a power consumption predicting method for shortening a test time necessary for predicting power consumption of a refrigerator having a defrosting heater, and a power consumption predicting apparatus adopting the same.

2. Description of the Related Art

A refrigerator maker should test power consumption of a refrigerator according to test conditions and methods stipulated by Korean Standard (KS) Power Consumption Test Regulations (hereinafter, "KS Regulations"), and display an amount of power consumption (watthour) calculated on the refrigerator.

According to current KS Power Consumption Test Regulations, power consumption of a refrigerator shall be measured under certain conditions after the refrigerator is activated under a standard condition (30±1° C.) in respect of an amount of power consumption, standard temperatures predetermined for a cooler chamber aid a freezer chamber, and humidity thereof, and then reaches a stable state. Here, a measuring unit is KWh (kilowatthour). In a refrigerator having an automatic defrosting function, a power consumption measuring test should start at the same time when a forced defrosting operation is performed, and continue for 24 hours. However, where a forced defrosting operation is not available, the power consumption measuring test starts at the time when an automatic defrosting operation commences, and continues for 24 hours. In particular, where an automatic defrosting operation is not finished within 24 hours but within 48 hours, power consumption for 48 hours is measured. Also, in the case that an automatic defrosting operation is not finished within 48 hours, power consumption for 72 hours is measured. The measured power consumption is calculated down to the third decimal point, and is then multiplied by a predetermined constant, to calculate a monthly or a yearly power consumption quantity.

Meanwhile, a refrigerator maker for manufacturing refrigerators for sale in U.S.A. should test power consumption thereof according to test conditions and methods stipulated by the U.S. Energy Standard Test Regulations (hereinafter, "US Regulations"), and display a power consumption quantity (watthour) calculated on the refrigerator.

Under the US Regulations, temperature control buttons in a freezer chamber and a cooler chamber are first set Low modes among High, Medium and Low modes in a refrigerator. After the refrigerator reaches a stable state, operation time of a compressor is measured in order to actually measure a defrosting timer cycle and predetermined values. Here, the defrosting timer cycle is a cumulative value of the compressor operation time, in which if the compressor is activated during the defrosting timer cycle or more, a defrosting heater is activated to remove frost built up on the evaporator. The reason why the defrosting timer cycle is actually measured is because a power consumption calculation equation varies according to whether or not the actually measured defrosting timer cycle is 14 hours or longer. Thus, when a compressure running ratio is generally 40–50%, the refrigerator should be activated for at least 28 hours or longer, to then be tested. In this case, if the temperatures of the cooler chamber and the freezer chamber are not predetermined values or less, respectively, the temperature control buttons of the cooler chamber and the freezer chamber are selected and set Medium modes among High, Medium and Low modes, and then predetermined values are actually measured, to then calculate power consumption according to relevant power consumption calculation equation.

A refrigerator maker who desires to sell new products in the Republic of Korea should measure actual power consumption of each refrigerator for at least 24 hours up to 72 hours at maximum. Also, a refrigerator maker who desires to sell new products in U.S.A., should perform a long-time test in order to actually measure a defrosting timer cycle, under which the test is performed for at least 12 hours up to 32 hours, if a compressor running ratio is 50% when the defrosting timer cycle is set 6 hours up to 64 hours. As a result, labor and material resources are considerably consumed. Also, as it takes a long time to perform a power consumption measurement test, exportation of the products to foreign countries would be delayed in contrast to the trend in which the life cycle of a product becomes shorter and shorter, and the refrigerator maker would fail in the marketing.

SUMMARY OF THE INVENTION

To solve the above problems, it is an object of the present invention to provide a power consumption predicting method and an apparatus adopting the same, by which power consumption of a refrigerator is predicted substantially same as a long-time test result calculated according to the KS Regulations and the US Regulations, but a power consumption measurement test time is shortened in the refrigerator having an automatic defrosting function.

To accomplish the above object of the present invention, there is provided a power consumption predicting method for a refrigerator having a compressor, an evaporator and a defrosting heater for removing the frost built up on the evaporator, the method comprising the steps of: setting a defrosting timer cycle which is expressed as a cumulative value of the operation time of the compressor; and performing a test run including a forced defrosting operation and a plurality of compressor cooling cycles, in order to predict power consumption of the refrigerator. In the test run step, the operation and the pause times of the compressor are measured in order to measure energy consumed for the measured time. Based on the measured value of the energy consumed is predicted a unit run cycle of the refrigerator (corresponding to the defrosting timer cycle. Accordingly, it is possible to predict the power consumption by estimating the energy consumed for a predetermined time. Here, the unit run cycle is obtained by adding a defrosting effect internal of time and a normal run time. The defrosting effect interval of time means an interval including the forced defrosting operation and the irregular compressor cooling cycle during the test run interval of time. The normal run time means an interval excluding the defrosting effect interval of time from the test interval of time, and means a time obtained by averaging the cooling cycle time during the normal interval.

In addition, the energy consumed for the operation and the pause times of the compressor is calculated by performing the steps of setting a reference prediction unit time, calculating a unit run energy, and summing energy consumption in at least one unit run cycle which is included wholly or partially in the reference prediction unit time based on the unit run energy.

Meanwhile, according to another aspect of the present invention, there is also provided a power consumption prediction apparatus for a refrigerator having a compressor an evaporator and a defrosting heater for removing frost built up on the evaporator in which a defrosting timer cycle expressed as a cumulative value of the operation time of the compressor is set, the power consumption prediction apparatus comprising: a controller for controlling the defrosting heater to operate to perform a forced defrosting and the compressor to perform a cooling cycle including pauses and operations several times; a time detector for detecting a defrosting time of the defrosting heater and pause and operation times of the compressor; an energy measuring unit for measuring the energy consumed during the defrosting time, the pause time, and the operation time, respectively; and an energy consumption calculator for estimating a unit run cycle of the refrigerator corresponding to the defrosting timer cycle based on the detected defrosting time, pause time and operation time, and estimating the energy consumed during a predetermined time.

BRIEF DESCRIPTION OF THE DRAWINGS

The object and other advantages of the present invention will become more apparent by describing in detail the structures and operations of the present invention with reference to the accompanying drawings, in which.

DETAILED DESCRIPTION OF THE INVENTION

Preferred embodiments of the present invention will be described in detail with reference to the accompanying drawings.

Figure 1:
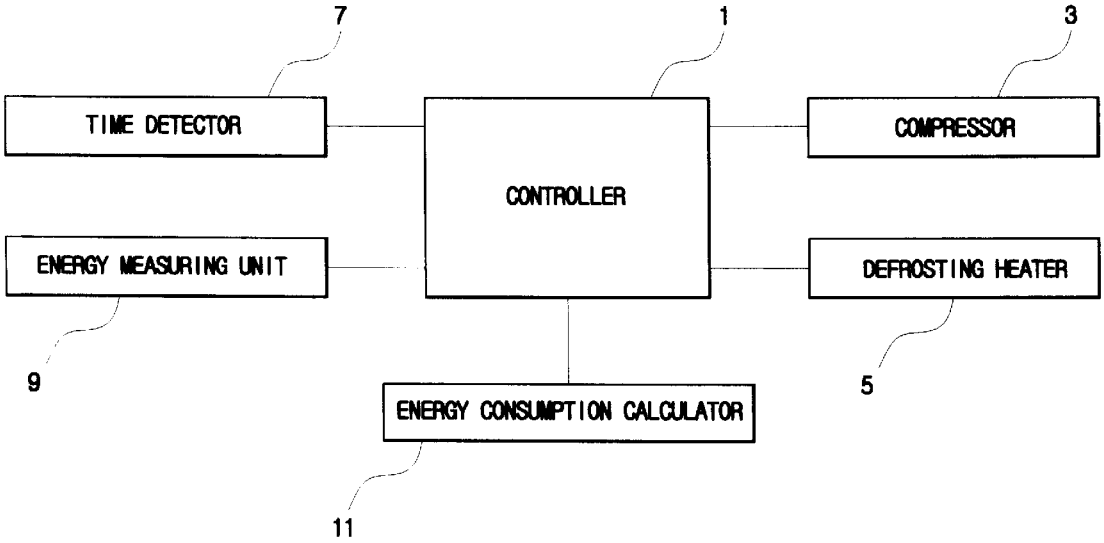
FIG. 1 is a block diagram showing a power consumption prediction apparatus for a refrigerator according to the present invention.

Referring to FIG. 1, a power consumption prediction apparatus for use in a refrigerator according to the present invention includes a compressor 3 installed on the bottom of the refrigerator, for compressing a coolant, a defrosting heater 5 installed below the evaporator, for removing frost on an evaporator, a controller 1 for controlling the compressor 3 to be deactivated or activated according to a detection value of an inner temperature detection sensor and controlling the defrosting heater 5 to operate in order to remove the frost, a time detector 7 for detecting pause and operation times of the compressor 3 and operation time of the defrosting heater 5, an energy measuring unit 9 for measuring energy consumed during pause and operation times of the compressor 3 and operation time of the defrosting heater 5, and an energy consumption calculator 11 for calculating energy consumption to be predicted in the refrigerator based on the detected values of the time detector 7 and the measured values of the energy measuring unit 9.

Figure 2:
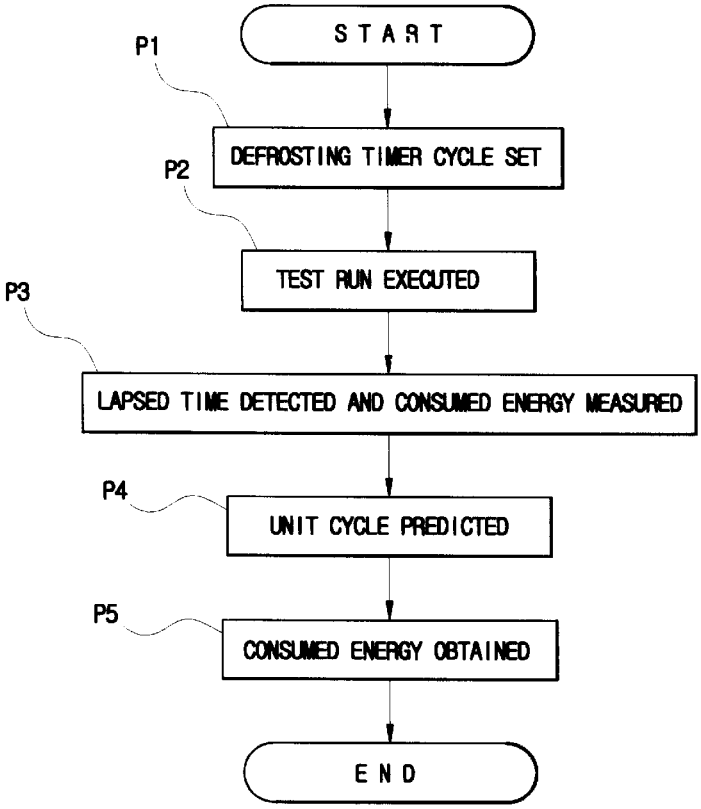
FIG. 2 is a flowchart view showing a power consumption prediction method for a refrigerator according to the present invention.

FIG. 2 is a flowchart view showing a power consumption prediction method for a refrigerator according to the present invention.

First, a defrosting timer cycle DEFTIMER of a refrigerator is set (P1). Here, the defrosting timer cycle means a time value in which if the cumulated operation time of the compressor is larger than a predetermined value, the defrosting heater 5 operates to perform defrosting in the evaporator. A predetermined defrosting timer cycle is preset in a refrigerator having an automatic defrosting function. Generally, the input value may range from 6 hours to 32 hours according to the capacity of a cooling chamber in the refrigerator. Thus, the defrosting timer cycle may be set the previously input defrosting timer cycle.

Then, a test run is executed in order to predict power consumption in a power consumption prediction apparatus for a refrigerator according to one embodiment of the present invention (P2). The test run for the power consumption prediction is performed under such conditions as stipulated by the KS Regulations. By doing so, the test results are legally admitted. Thus, if the conditions according to the KS Regulations are altered, the test run should be executed according to the altered conditions. The test run starts while forced defrosting or automatic defrosting is in operation after a refrigerator is activated under the standard conditions of the KS Regulations and then reaches a stable state.

Figure 3:
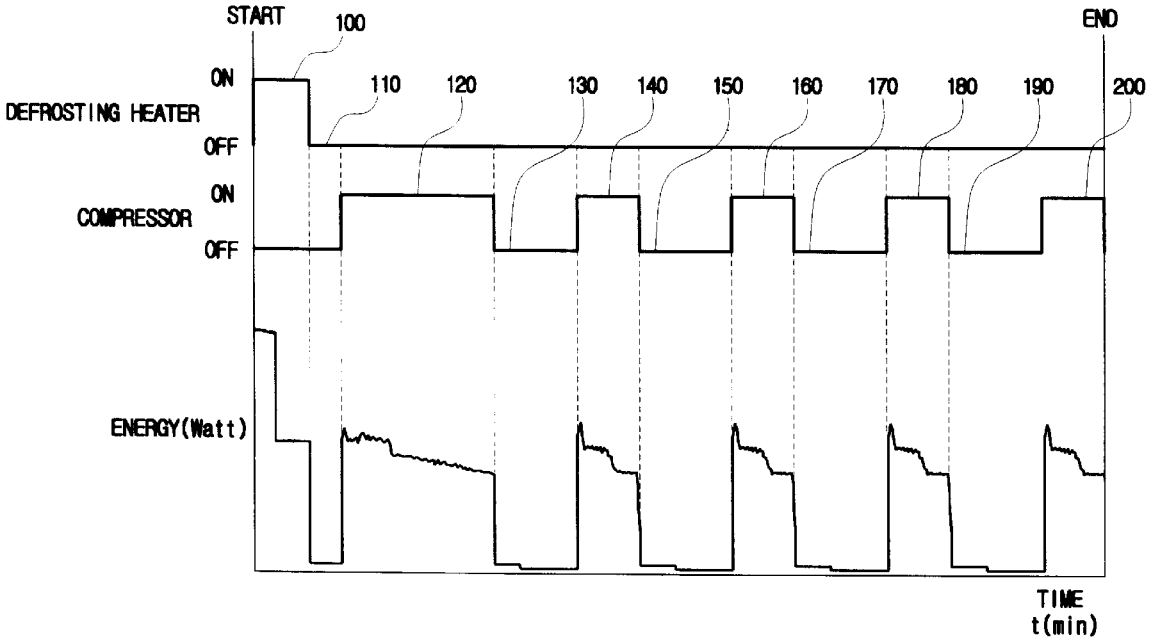
FIG. 3 is a graphical timing diagram showing a test run interval in order to predict power consumption according to one embodiment of the present invention.
Figure 4A:
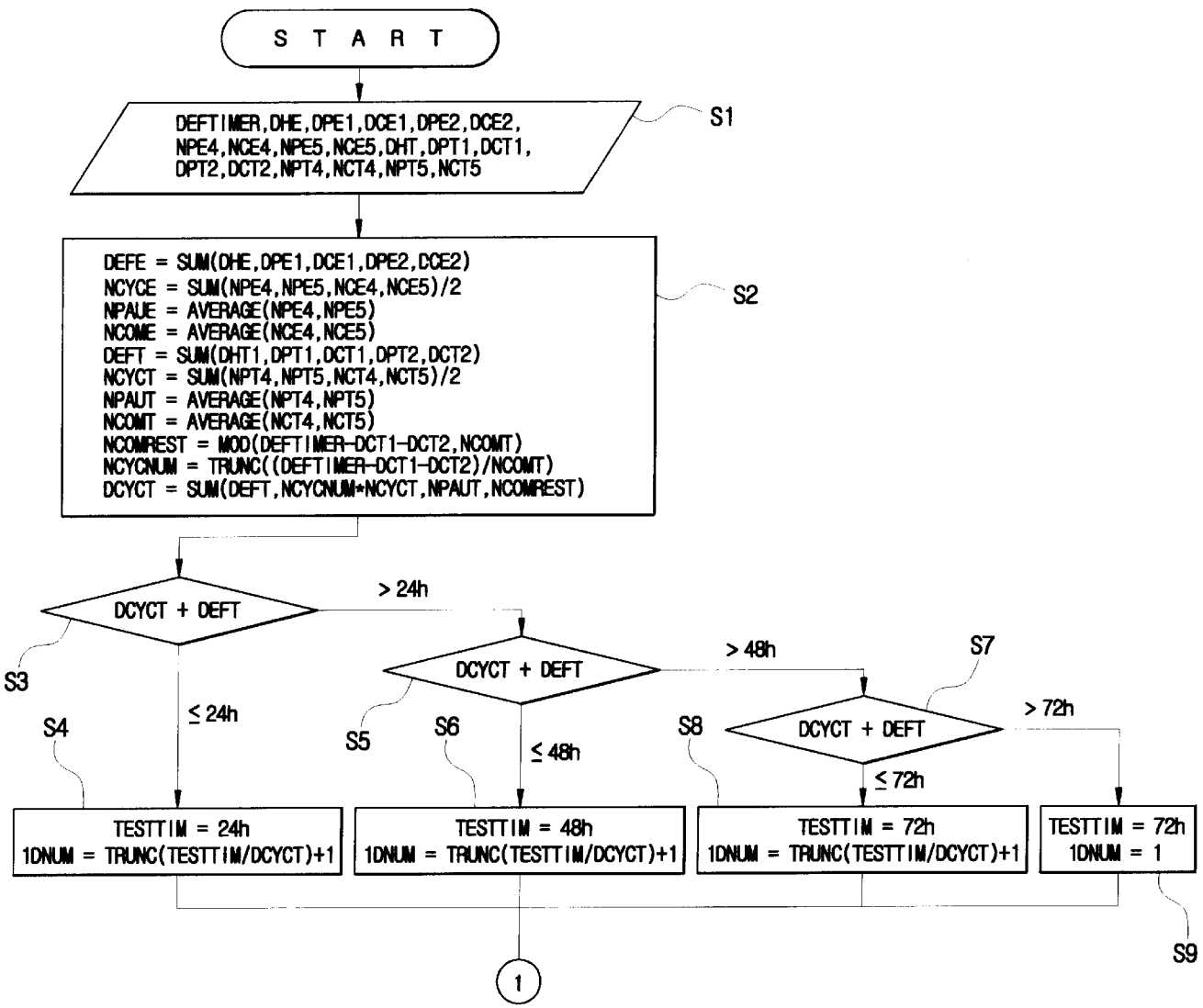
FIGS. 4*a*, 4*b*, 4*c* and 4*d* are flowchart views illustrating processes for estimating energy consumption according to one embodiment of the present invention.
Figure 4B:
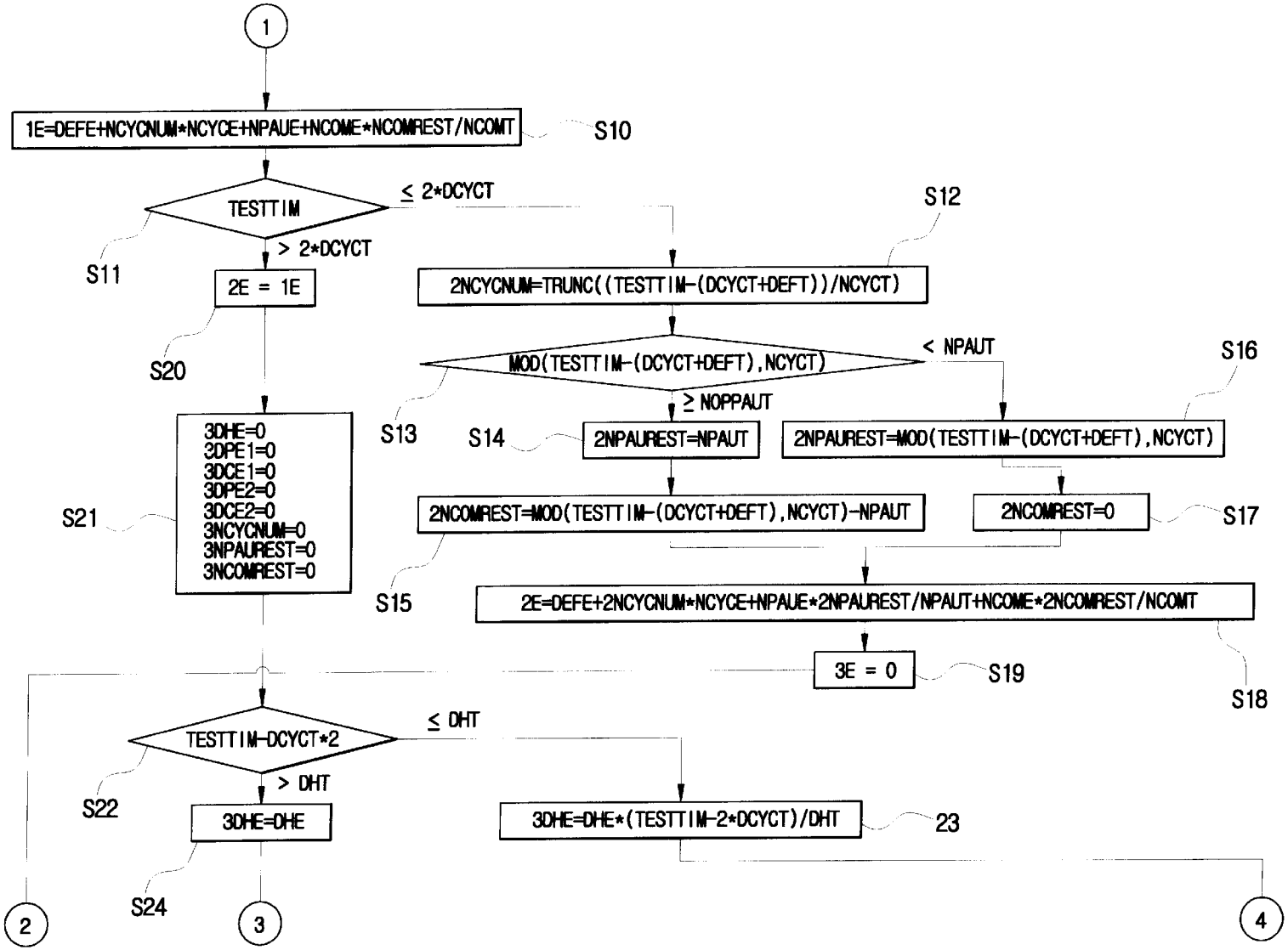
Figure 4C:
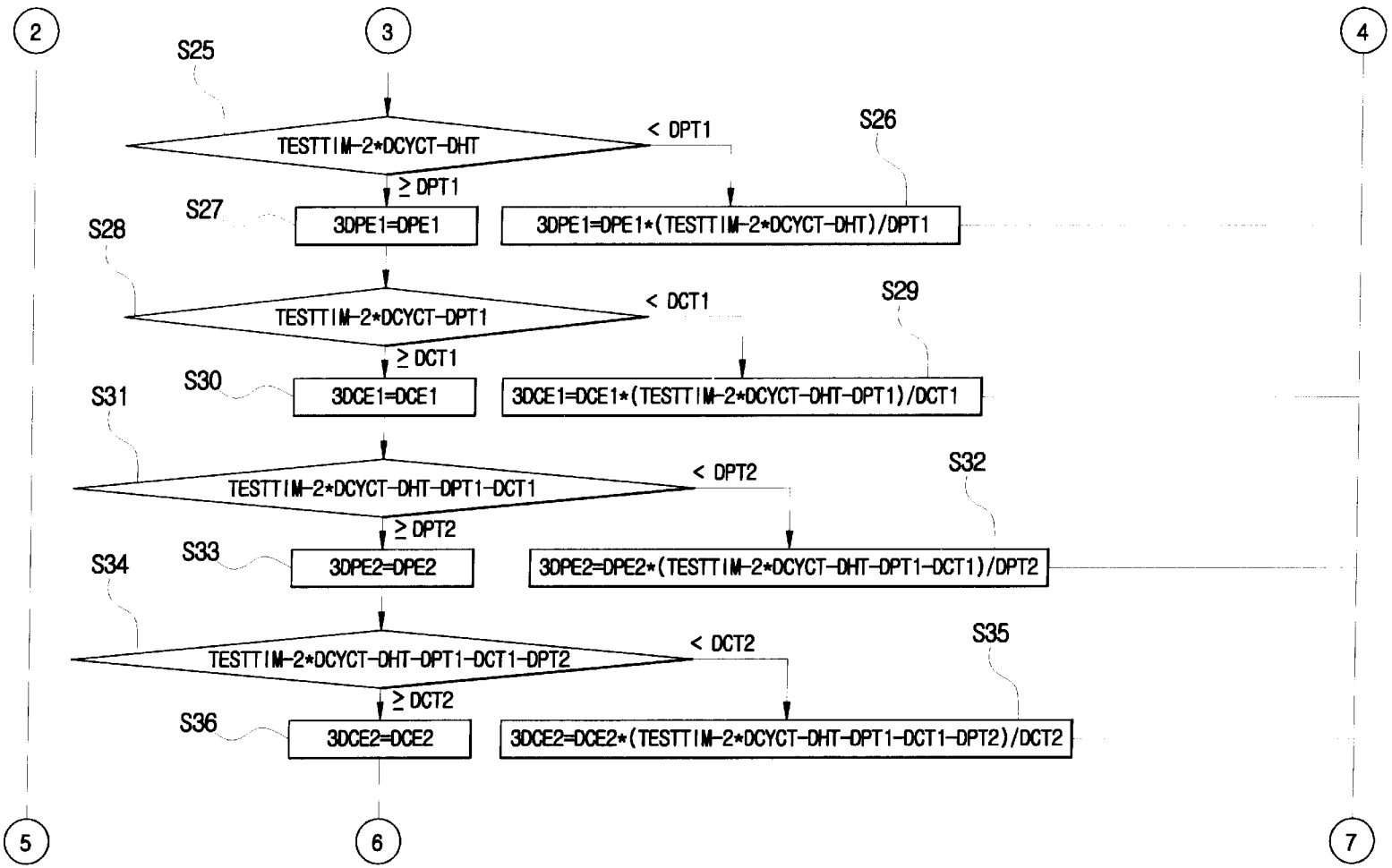
Figure 4D:
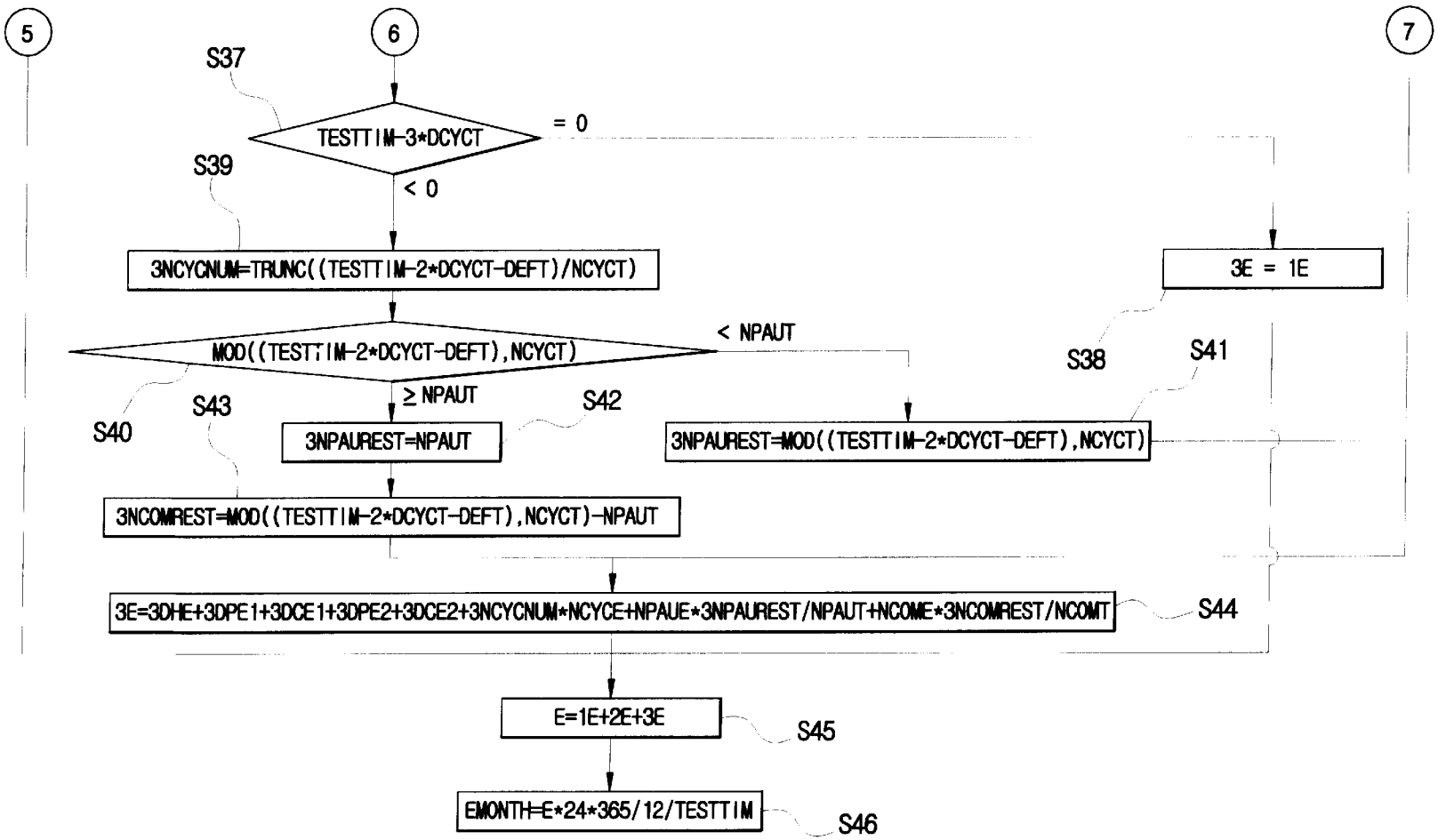

FIG. 3 is a graphical timing diagram showing a test run interval in order to predict power consumption according to one embodiment of the present invention.

FIG. 3 illustrates a timing block diagram showing states where the defrosting heater 5 and the compressor 3 are activated or deactivated in a defrosting effect interval where an evaporator is defrosted and a normal interval while the compressor 3 for supplying a cooling air into a cooling chamber is deactivated and activated, and the energy consumption therein according to lapse of time. The defrosting effect interval means an interval ranging from a point in time in which the defrosting heater is activated and defrosting of the evaporator is performed, to a point in time in which a cooling cycle of the compressor including a predetermined pause period and a predetermined operation period is completed two times, The consumed energy in the defrosting effect interval does not have a constant period and is irregular. Meanwhile, a normal interval following the defrosting effect interval is an interval during which a cooling cycle is completed three times, in which the regular energy consumption is shown to have a constant period.

Under the control of the controller 1, the defrosting heater 5 operates during a defrosting time DHT (100) in the defrosting effect interval. Then, when a first pause time DPT1 (110) lapses and an inner temperature in the refrigerator is higher than a predetermined temperature, the compressor 3 operates, to supply a cooling air into the refrigerator. When a first operation time DCT1 (120) lapses and an inner temperature in the refrigerator is lower than a predetermined temperature, the compressor 3 stops. Then, when a second pause time DPT2 (130) lapses and an inner temperature in the refrigerator is higher than the predetermined temperature, the compressor 3 operates. When a second operation time DCT2 (140) lapses, the compressor 3 stops. In the following normal interval, after a third pause time NPT3 (150) lapses, the compressor 3 operates. If a third operation time (NCT3) (160) lapses, the compressor 3 stops. If a fourth pause time NPT 4 (170) lapses, the compressor 3 is activated. If a fourth operation time (NCT4) (180) lapses, the compressor 8 stops. If a fifth pause time NPT 5 (190) lapses, the compressor 3 is activated. Then, if a fifth operation time NCT5 (200) lapses, the compressor 3 stops.

Based on a signal from the controller 1 indicating operation and pause of the defrosting heater 5 and the compressor 3, the time detector 7 detects a defrosting time DHT, a first pause time DPT1, a first operation time DCT1, a second pause time DPT2, a second operation time DCT2, a fourth pause time NPT4, a fourth operation time NCT4, a fifth pause time NPT5 and a fifth operation time NCT5. and the energy measuring unit 9 measures the energy consumed during each time (P3 of FIG. 2). The measured energy consumption is a sum of the defrosting Energy DHE during the defrosting time DHT, the first pause energy DPE1 during the first pause time DPT1, the first operation energy DCE1 during the first operation time DCT1, the second pause energy DPE2 during the second pause time DPT2, the second operation energy DCE2 during the second operation time DCT2, the fourth pause energy NPE4 during the fourth pause time NPT4, the fourth operation energy NCE4 during the fourth operation time NCT4, the fifth pause energy NPE5 during the fifth pause time NPT5, and the fifth operation energy NCE5 during the fifth operation time NCT5. In units of measurement, a time unit is minute (min) and an energy unit is watthour (Wh).

The reason, why the third pause time and the third operation time and the energy consumption for each pause and operation time are not measured, resides in consideration of stabilization in the energy consumption in a normal interval following the defrosting effect interval. Accordingly, more accurate measured values are obtained in order to heighten a reliability of power consumption prediction. In this manner, a test for power consumption prediction is completed.

In the test, it takes about six hours in average, when a general operation time of the defrosting heater and the pause and operation times of the compressor in the defrosting effect interval and the normal interval are taken into consideration.

As described above, the reason why it is possible to predict the power consumption of a refrigerator through a short-time test is because the energy consumption during the operation or pause of the compressor has a constant period, except for the consumed energy during the defrosting effect interval.

In addition, when a user uses a refrigerator for usual purpose, an inner temperature of the refrigerator varies according to a set temperature in the inside of the cooling chamber, a refrigerator installation environment and a user's behavior in use, and thus the operation cycles of the compressor and the defrosting heater are determined Accordingly, an interval of time during which defrosting is executed is variable. However, since the power consumption prediction test of the refrigerator is performed at the state where doors are closed without opening and closing the doors or storing and withdrawing foods in and from the refrigerator, a defrosting cycle is nearly constant.

Thus, the actual energy consumed in the refrigerator for a reference prediction unit time according to the KS Regulations can be predicted based on each value obtained by the above-described test without actually measuring the energy consumption.

If the above test is completed, a unit run cycle (DCYCT) of the refrigerator corresponding to a defrosting timer cycle (DEFTIMER) is predicted based on each detected time value (P4 of FIG. 2). The unit run cycle (DCYCT) of the refrigerator means an interval of time during which defrosting is performed, which is expressed as a time value between a point in time at which defrosting is started and a point in time at which next defrosting is started.

To estimate a unit run cycle (DCYCT), it requires for obtaining the following values based on each time value. The values to be obtained are a defrosting effect interval (DEFT), a normal cycle (NCYCT) meaning a cooling cycle during the normal interval, a normal operation time (NCOMT) meaning an operation time of the compressor 3 during the normal interval, a normal pause time (NPAUT) meaning a pause time of the compressor 3 during the normal interval, and a number of normal cycle times (NCYCNUM) of the unit run cycle (DCYCT). These are obtained by the following equations (1) through (5)

$$DEFT=SUM(DHT, DPT1, DCT1, DPT2, DCT2) \quad (1)$$

$$NCYCT=SUM(NPT4, NCT4, NPT5, NCT5)/2 \quad (2)$$

$$NCOMT=AVERAGE(NCT4, NCT5) \quad (3)$$

$$NPAUT=AVERAGE(NPT4, NPT5) \quad (4)$$

$$NCYCNUM=TRUNC((DEFTIMER-DCT1-DCT2)/NCOMT) \quad (5)$$

Here, (DEFTIMER−DCT1−DCT2) means a normal defrosting timer cycle, which is obtained by excluding the operation time of the compressor 3 in the defrosting effect interval from the defrosting timer cycle.

Meanwhile, in the case that the defrosting timer cycle is finished during the operation of the compressor 3 and the defrosting heater 5 is activated, and thus the compressor 3 stops at the same time when defrosting is executed, a normal operation remaining interval (NCOMREST) meaning the operation time of the compressor which does not exert a normal operation time (NCOMT) is obtained by the following equation (6).

$$NCOMREST=MOD(DEFTIMER-DCT1-DCT2, NCOMT) \quad (6)$$

Based on the values obtained from the equations (1) through (6), the unit run cycle (DCYCT) of the refrigerator is expressed as the following equation (7).

$$DCYCT=SUM(DEFT, NCYCNUM*NCYCT, NPAUT, NCOMREST) \quad (7)$$

Here, NCYCNUM*NCYCT+NPAUT+NCOMREST means a normal run time which is obtained by excluding the defrosting effect interval (DEFT) from the unit run cycle (DCYCT).

Then, based on the measured values of the energy measuring unit 9, a defrosting effect interval energy (DEFE) being the energy consumed during the defrosting effect time (DEFT), a normal cycle energy (NCYCE) being the energy consumed during the normal cycle (NCYCT), a normal pause energy (NPAUE) being the energy consumed during the normal pause time (NPAUT), and a normal operation energy (NCOME) being the energy consumed during the normal operation time (NCOMT) are obtained by the following equations (8) through (11) (P5 of FIG. 2).

$$DEFE=SUM(DHE, DPE1, DCE1, DPE2, DCE2) \quad (8)$$

$$NCYCE=SUM(NPE4, NPE5, NCE4, NCE5)/2 \quad (9)$$

$$NPAUE=AVERAGE(NPE4, NPE5) \quad (10)$$

$$NCOME=AVERAGE(NCE4, NCE5) \quad (11)$$

Thus, all the values necessary for prediction of the power consumption can be seen. As a result, the energy consumed is estimated on the basis of each value obtained by the above equations (P5 of FIG. 2), to then complete the power consumption prediction for the refrigerator.

FIGS. 4*a*, 4*b*, 4*c* and 4*d* are flowchart views illustrating processes for estimating energy consumption according to one embodiment of the present invention. The process for estimating energy consumption will be described below in more detail.

Referring to FIGS. 4*a*, 4*b*, 4*c* and 4*d*, the energy consumption estimation is limited to the cases that three defrosting effect intervals at maximum exist within a predetermined reference prediction unit time, that is, three unit run cycles of the refrigerator are included therein at the longest (TESTTIM=3 * DCYCT). In other words, in this flowchart view, the energy consumption in the refrigerator during the first unit run cycle included in the reference prediction unit time is indicated as a first unit run energy (1E), the energy consumption in the refrigerator during the second unit run cycle included in the reference prediction unit time is indicated as a second unit run energy (2E), and the energy consumption in the refrigerator during the third unit run cycle included in the reference prediction unit time is indicated as a third unit ruin energy (3E). Each unit energy value (1E, 2E, 3E) is predicted and then summed to obtain the energy consumption (E) consumed in the refrigerator during the reference prediction unit time, based on which a yearly power consumption or a yearly averaged monthly power consumption is calculated. Thus, in the case that a fourth defrosting effect interval is progressed within the reference prediction unit time, the contents in the flowchart view should be added in the same manner. However, considering that a compressor running ratio is 40–50% although the defrosting timer cycle is set 6 hours, comparatively a short time, there may not exist the case that the fourth defrosting effect interval exists actually in the reference prediction unit time.

Referring back to FIGS. 4*a* through 4*d*, in order to better understand the power consumption prediction method according to one embodiment of the present invention, the values of the measured testing results are set initial values (S1), based on which the step (S2) of obtaining the values necessary for the power consumption prediction according to the equations (1) through (11) is included.

Then, it is judged whether a unit run including a forced defrosting and an intial automatic defrosting has been completed within 24 hours, that is, a sum of the unit run cycle (DCYCT) and a defrosting effect time (DEFT) is 24 hours (1440 minutes) or smaller (S3).

If the initial automatic defrosting is completed within 24 hours, the reference prediction unit time (TESTTIM) is set 24 hours. The number of times of defrosting (DNUM) in the reference prediction unit time (TESTTIM) becomes two (2) by summing the numbers of times of the forced defrosting and the initial automatic defrosting. The number of times of defrosting (DNUM) is obtained by dividing the reference prediction unit time (TESTTIM) by the unit run cycle (DCYCT) and discarding the places below the decimal point and then adding one (1) to the result (S4).

If the initial automatic defrosting is not completed within 24 hours, it is judged whether an initial automatic defrosting has been completed within 48 hours, that is, a sum of the unit run cycle (DCYCT) and a defrosting effect time (DEFT) is 48 hours or smaller (S5).

If a sum of the unit run cycle (DCYCT) and the defrosting effect time (DEFT) is 48 hours or less, the reference prediction unit time (TESTTIM) is set 48 hours. The number of times of defrosting (DNUM) in the reference prediction unit time (TESTTIM) becomes two (2) as in the above-described manner by dividing the reference prediction unit time (TESTTIM) by the unit run cycle (DCYCT) and discarding the places below the decimal point and then adding one (1) to the result (S6).

If the initial automatic defrosting is not completed within 48 hours, it is judged whether an intial automatic defrosting has been completed within 72 hours, that is, a sum of the unit run cycle (DCYCT) and a defrosting effect time (DEFT) is 72 hours or less (S7).

If a sum of the unit run cycle (DCYCT) and the defrosting effect time (DEFT) is 72 hours or less, the reference prediction unit time (TESTTIM) is set 72 hours. The number of times of defrosting (DNUM) in the reference prediction unit time (TESTTIM) becomes two (2) as in the previous manner (S8).

Finally, if the initial automatic defrosting is not completed within 72 hours, the reference prediction unit time (TESTTIM) is set 72 hours, and thus the number of times of defrosting (DNUM) becomes one (1) (S9).

The reason why the reference prediction unit time (TESTTIM) is set one of the predicted unit times of 24, 48 and 72 hours based on the completion point in time of the initial automatic defrosting following the forced defrosting resides in the testing conditions in the KS Regulations. In the case of the power consumption prediction method according to one embodiment of the present invention, the reason is to show that the substantially same results can be obtained without performing an actual time test (from 24 hours to 72 hours) according to the current KS power consumption quantity testing conditions. Thus, if such conditions are altered, the power consumption prediction method according to one embodiment of the present invention should be adjusted properly.

The energy consumption of the unit run cycle (DCYCT) of the refrigerator which has been consumed from the time when forced defrosting is performed till before the initial automatic defrosting is performed, that is, a first unit run energy (1E) is summed according to the following equation (12) (S10).

$$1E=DEFE+NCYCNUM*NCYCE+NPAUE+NCOME*NCOMREST/NCOMT \quad (12)$$

Here, the term NCYCNUM * NCYCE+NPAUE represents the normal run energy of the refrigerator during the normal interval, and NCOME * NCOMREST/NCOMT represents the energy consumption of the refrigerator during the remaining interval which does not exert the normal cycle.

Then, it is judged whether or not a unit run cycle (DCYCT) is included two times or more within the reference prediction unit time (TESTTIM) (S11). That is, it is judged whether the reference prediction unit time (TESTTIM) is larger than the value double the unit run cycle (DCYCT).

In the case that the reference prediction unit time (TESTTIM) is smaller than or equal to the value double the unit run cycle (DCYCT), the energy (2E) consumed from the unit run cycle (DCYCT) till the time when the reference prediction unit time (TESTTIM) is completed is calculated by the following sequence, to thereby obtain the energy consumed during the reference prediction unit time. Here, in the process of calculating the consumed energy (2E), the meaning of each variable is the same as those of the previous ones, in which the number 2 in front of each variable is not a coefficient, but indicates a variable for obtaining a second unit run energy.

First, a second normal cycle number of times (2NCYCNUM) after the unit run cycle (DCYC1) is obtained by the following equation (13) (S12). Here, the second normal cycle number of times (2NCYCNUM) represents a normal cycle number of times at the time corresponding to a second unit run cycle of the reference prediction unit time (TEETTIM).

$$2NCYCNUM=TRUNC(TESTTIM-(DCYCT+DEFT)/NCYCT) \quad (13)$$

Then, it is judged whether a remaining interval MOD (TESTTIM−(DCYCT+DEFT), NCYCT) of the equation (13) is larger or smaller than the normal pause time (NPAUT) (S13).

If MOD(TESTTIM−(DCYCT+DEFT), NCYCT) is larger than the normal pause time (NPAUT), it means that before the normal operation time (NCOMT) of the normal cycle is not completed, the reference prediction unit time (TESTTIM) is completed. Thus, the second normal pause remaining interval (2NPAUREST) of the normal remaining interval is the same as the normal pause time (NPAUT) (S14). Here, the second normal pause remaining interval (2NPAUREST) means a pause time of an uncompleted normal cycle when the normal cycle is not completed and the reference prediction unit time (TESTTIM) is completed. Also, the second normal operation remaining interval (2NCOMREST) becomes the following equation (14) (S15).

$$2NCOMREST=MOD(TESTTIM-(DCYCT+DEFT), NCYCT)-NPAUT \quad (15)$$

Meanwhile, if MOD(TESTTIM−(DCYCT+DEFT), NCYCT) is smaller than NPAUT, it means that before a normal pause time (NPAUT) of the normal cycle is not completed, the reference prediction unit time (TESTTIM) is completed. Accordingly, the second normal pause remaining interval (2NPAUREST) of the normal remaining interval becomes the following equation (15) (S16).

$$2NPAUREST=MOD(TESTTIM-(DCYCT+DEFT), NCYCT) \quad (15)$$

The second normal operation remaining interval (2NCOMREST) of the normal remaining interval becomes the following equation (16) (S17).

$$2NCOMREST=0 \quad (16)$$

Therefore, in the case that the reference prediction unit time (TESTTIM) is smaller than the value double the unit run cycle (DCYCT), the second unit run energy (2E) is obtained by the following equation (17) (S18).

$$2E=DEFE+2NCYCNUM*NCYCE+NPAUE*2NPAUREST/NPAUT+NCOME*2NCOMREST/NCOMT \quad (17)$$

Also, the third unit run energy (3E) becomes naturally zero (0) since the third unit run cycle (DCYCT) is not included in the reference prediction unit time (TESTTIM) (S19). Accordingly, the first unit run energy (1E), the second unit run energy (2E), and the third unit run energy (3E) are all obtained. Thus, the energy consumption (E) during the reference prediction unit time (TESTTIM) can be obtained (S45).

In the case that the reference prediction unit time (TESTTIM) is larger than the value double the unit run cycle (DCYCT) (S11), the second unit run cycle (DCYCT) is perfectly included in the reference prediction unit time (TESTTIM), and the third unit run cycle is included in part or in whole in the reference prediction unit time (TESTTIM). Thus, the second unit run cycle (2E) being the consumed energy of the second unit run cycle (DCYCT) can be estimated to be the same as the first unit run energy (1E) based on the fact that the energy consumption of the refrigerator has a constant periodicity, as described with reference to FIG. 3. Accordingly, the following equation (18) is met (S20).

$$2E=1E \quad (18)$$

The consumed energy during the unit run cycle (DCYCT) included in the reference prediction unit time (TESTTIM) varies according to whether or not the defrosting effect interval and the normal cycle of the third unit run energy (DCYCT) is included, that is, according to the length of the third unit run cycle (DCYCT) included in the reference prediction unit time (TESTTIM) which is a value by subtracting the value double the unit run cycle (DCYCT) from the reference prediction unit time (TESTTIM). First, the values necessary for obtaining the consumed energy of the third unit run cycle, that is, the energy consumed during the defrosting time (3DHE), the energy consumed during the first pause time (3DPE1) in the defrosting effect interval, the energy consumed during the first operation time (3DCE1), the energy consumed during the second pause time (3DPE2), the second operation time (3DCE2), the normal cycle number of times (3NCYCNUM) in the normal interval, the normal pause remaining interval (3NPAUREST) and the normal operation remaining interval (3NCOMREST) are all set zero (0) (S21). In the case that there exists at least one non-zero value among the above values according to the length of the unit run cycle (DCYCT) included in the reference prediction unit time (TESTTIM), the value is altered into a corresponding value, to thus be calculated to the consumed energy (3E). Here, as in the previous description, the meaning of each variable is the same as those of the previous ones, in which the number 3 in front of each variable is not a coefficient, but indicates a variable for obtaining a third unit run energy.

In the following, the steps of calculating the consumed energy (3E) during the third unit run cycle included in the reference prediction unit time (TESTTIM) will be described in more detail.

First, it is judged whether the value obtained by subtracting the value double the unit run cycle (DCYCT) from the reference prediction unit time (TESTTIM) is smaller than or equal to the defrosting time (DHT) (S22). If the former is smaller than or equal to the latter, the energy (3DHE) consumed during the defrosting time (DHT) becomes the following equation (19) (S23).

$$3DHE=DHE*(TESTTIM-2*DCYCT)/DHT \quad (19)$$

By doing so, the values necessary for calculating the third unit run energy (3E) have been all calculated, and the third unit run energy (3E) becomes 3HDE (S49).

Meanwhile, in the case that the value obtained by subtracting the value double the unit run cycle (DCYCT) from the reference prediction unit time (TESTTIM) is larger than the defrosting time (DHT) (S22), the energy (3DHE) consumed during the defrosting time (DHT) becomes the following equation (20) (S24).

$$3DHE=DHE \quad (20)$$

It is judged whether TESTTIM−2 * DCYCT−DHT is larger than or smaller than the first pause time (DPT1) (S25).

In the case that TESTTIM−2 * DCYCT−DHT is smaller than the first pause time (DPT1), the energy (3DPE1) consumed during the first pause time (DPT1) becomes the following equation (21) (S26).

$$3DPE1=DPE1*(TESTTIM-2*DCYCT-DHT)/DPT1 \quad (21)$$

By doing so, all the values necessary for calculating the third unit run energy (3E) are calculated. Thus, the following equation (22) is met (S49).

$$3E=3DHE+3DPE1 \quad (22)$$

If TESTTIM−2 * DCYCT−DHT is larger than or equal to the first pause time (DPT1) (S25), the energy (3DPE1) consumed during the first pause time (DPT1) becomes the following equation (23) (S27).

$$3DPE1=IDPE1 \quad (23)$$

It is judged whether TESTTIM−2 * DCYCT−DHT−DPT1 is larger than or smaller than the first operation time (DCT1) (S28).

If TESTTIM−2 * DCYCT−DHT−DPT1 is smaller than the first operation time (DCT1), the energy (3DCE1) consumed during the first operation time (DCT1) becomes the following equation (24) (S29).

$$3DCE1=DCE1*(TESTTIM-2*DCYCT-DHT-DPT1)/DCT1 \quad (24)$$

Thus, all the values necessary for calculating the third unit run energy (3E) are calculated. Accordingly, the following equation (25) is met (S49).

$$3E=3DHE+3DPE1+3DCE1 \quad (25)$$

If TESTTIM−2 * DCYCT−DHT−DPT1 is larger than or equal to the first operation time (DCT1), the energy (3DCE1) consumed during the first operation time (DCT1) becomes the following equation (26) (S30).

$$3DCE1=DCE1 \quad (26)$$

It is judged whether TESTTIM−2 * DCYCT−DHT−DPT1−DCT1 is larger than or smaller than the second pause time (DPT2) (S31).

If TESTTIM−2 * DCYCT−DHT−DPT1−DCT1 is smaller than the second pause time (DPT2), the energy (3DPE2) consumed during the second pause time (DPT2) becomes the following equation (27) (S32).

$$3DPE2=DPE2*(TESTTIM-2*DCYCT-DHT-DPT1-DCT1)/DPT2 \quad (27)$$

Thus, the following equation (28) is met (S49).

$$3E=3DHT+3DPE1+3DCE1+3DPE2 \quad (28)$$

If TESTTIM−2 * DCYCT−DHT−DPT1−DCT1 is larger than or smaller than the second pause time (DPT2) (S31), the energy (3DPE2) consumed during the second pause time (DPT2) becomes the following equation (29) (S33).

$$3DPE2=DPE2 \quad (29)$$

It is judged whether TESTTIM−2 * DCYCT−DHT−DPT1−DCT1−DPT2 is larger than or smaller than the second operation time (DCT2) (S34).

If TESTTIM−2 * DCYCT−DHT−DPT1−DCT1−DPT2 is smaller than the second operation time (DCT2), the energy (3DCE2) consumed during the second operation time (DCT2) becomes the following equation (30) (S35).

$$3DCE2=DCE2*(TESTTIM-2*DCYCT-DHT-DPT1-DCT1-DPT2)/DCT2 \quad (30)$$

Thus, the following equation (31) is met (S49).

$$3E=3DHE+3DPE1+3DCE1+3DPE2+3DCE2 \quad (31)$$

If TESTTIM−2 * DCYCT−DHT−DPT1−DCT1−DPT2 is larger than or equal to the second operation time (DCT2) (S34), the energy (3DCE2) consumed during the second operation time (DCT2) becomes the following equation (32) (S36).

$$3DCE2=DCE2 \quad (32)$$

It is judged whether TESTTIM−3 * DCYCT is smaller than or equal to zero (S37). TESTTIM−3* DCYCT cannot be larger than zero, because the present flowchart is limited to the case that the third defrosting effect interval is included in the reference prediction unit time (DCYCT).

In the case that TESTTIM−3 * DCYCT is zero, the following equation (32) is met (S38).

$$3E=1E \quad (32)$$

If TESTTIM−3 * DCYCT is smaller than zero (S37), the following equation (33) is met (S39).

$$3NCYCNUM=TRUNC((TESTTIM-2*DCYCT-DEFT)/NCYCT) \quad (33)$$

It is judged whether MOD((TESTTIM−2 * DCYCT−DEFT), NCYCT) is larger than or smaller than the normal pause time (NPAUT) (S40). If MOD((TESTTIM−2 * DCYCT−DEFT), NCYCT) is smaller than the normal pause time (NPAUT), the third normal pause remaining time (3NPAUREST) in the normal remaining interval becomes the following equation (34) (S41).

$$3NPAUREST=MOD((TESTTIM-2*DCYCT-DEFT), NCYCT) \quad (34)$$

Thus, the third unit run energy (3E) becomes the following equation (35) (S44).

$$3E=3DHE+3DPE1+3DCE1+3DPE2+3DCE2+3NCYCNUM*NCYCE+NPAUE*3NPAUREST/NPAUT \quad (35)$$

If MOD((TESTTIM−2 * DCYCT−DEFT), NCYCT) is larger than or equal to the normal pause time (NPAUT) (S40), the third normal pause remaining interval (3NPAUREST) in the normal remaining interval becomes the following equation (36) (S42).

$$3NPAUREST=NPAUT \quad (36)$$

The third normal operation remaining interval (3NPAUREST) in the normal remaining interval becomes the following equation (37) (S43).

$$3NCOMREST=MOD(TESTTIM-2*DCYCT-DEFT, NCYCT)-NPAUT \quad (37)$$

Thus, the third unit run energy (3E) becomes the following equation (38) (S44).

$$3E=3DHE+3DPE1+3DCE1+3DPE2+3DCE2+3NCYCNUM*NCYCE+NPAUE+NCO\ ME*3NCOMREST/NCOMT \quad (38)$$

Therefore, the energy (E) consumed in the refrigerator during the reference prediction unit time (TESTTIM) becomes 1E+2E+3E (S45), and the monthly energy consumption EMONTH becomes the following equation (39) (S46).

EMONTH=E*24*365/12/TESTTIM (39)

Figures 5, 6:
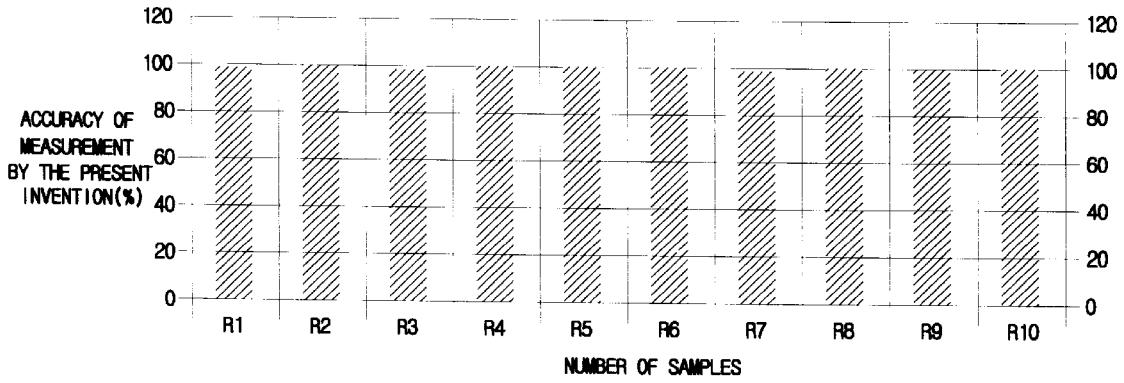
FIG. 5 shows a result obtained based on a power consumption prediction method of a refrigerator according to one embodiment of the present invention.
FIG. 6 is a graphical view showing an accuracy of power consumption test results according to one embodiment of the present invention on the basis of the result obtained according to the KS Regulations.
Figure 7A:
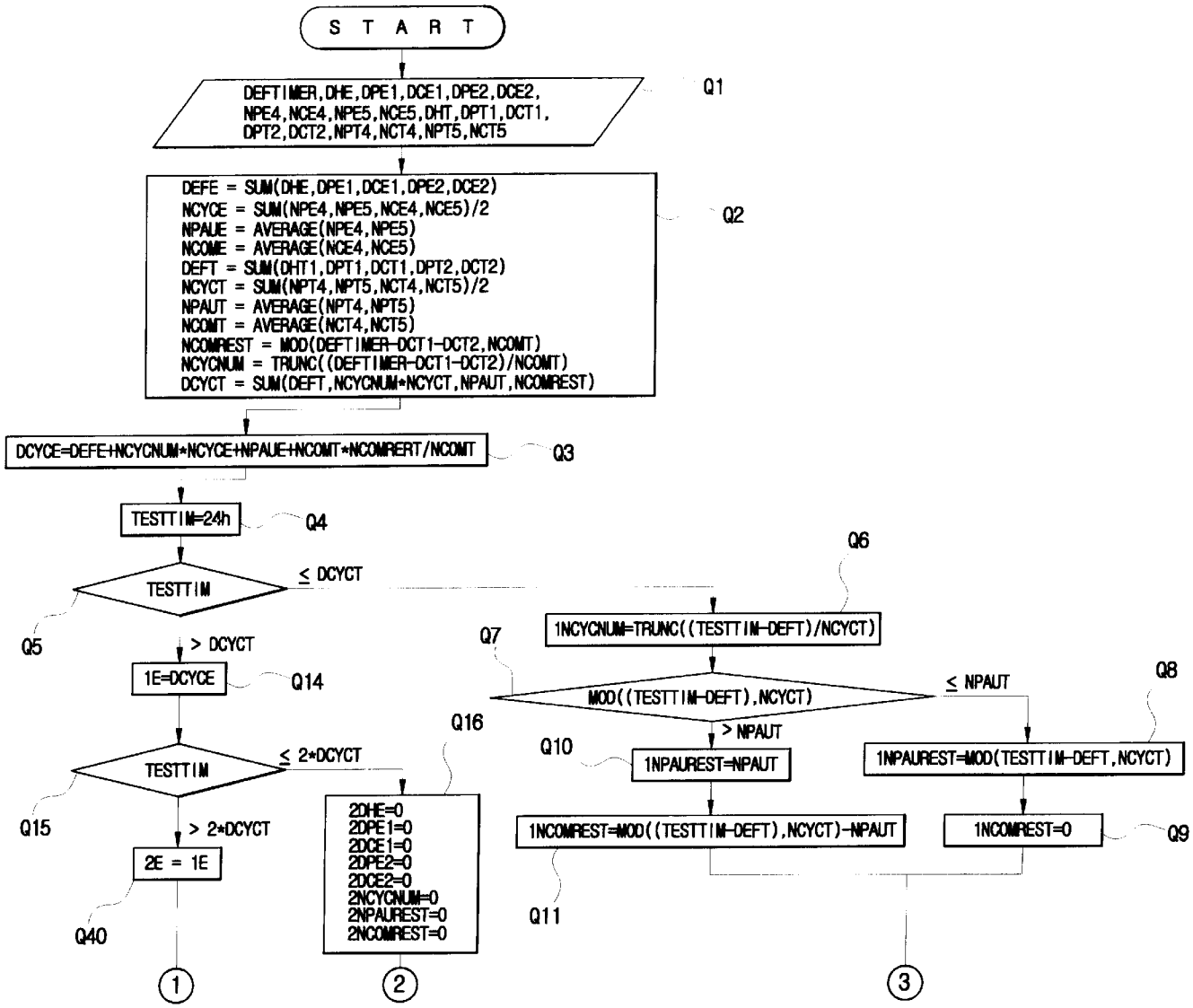
FIGS. 7*a*, 7*b*, 7*c* and 7*d* are flowchart views illustrating processes for estimating Energy consumption according to another embodiment of the present invention.
Figure 7B:
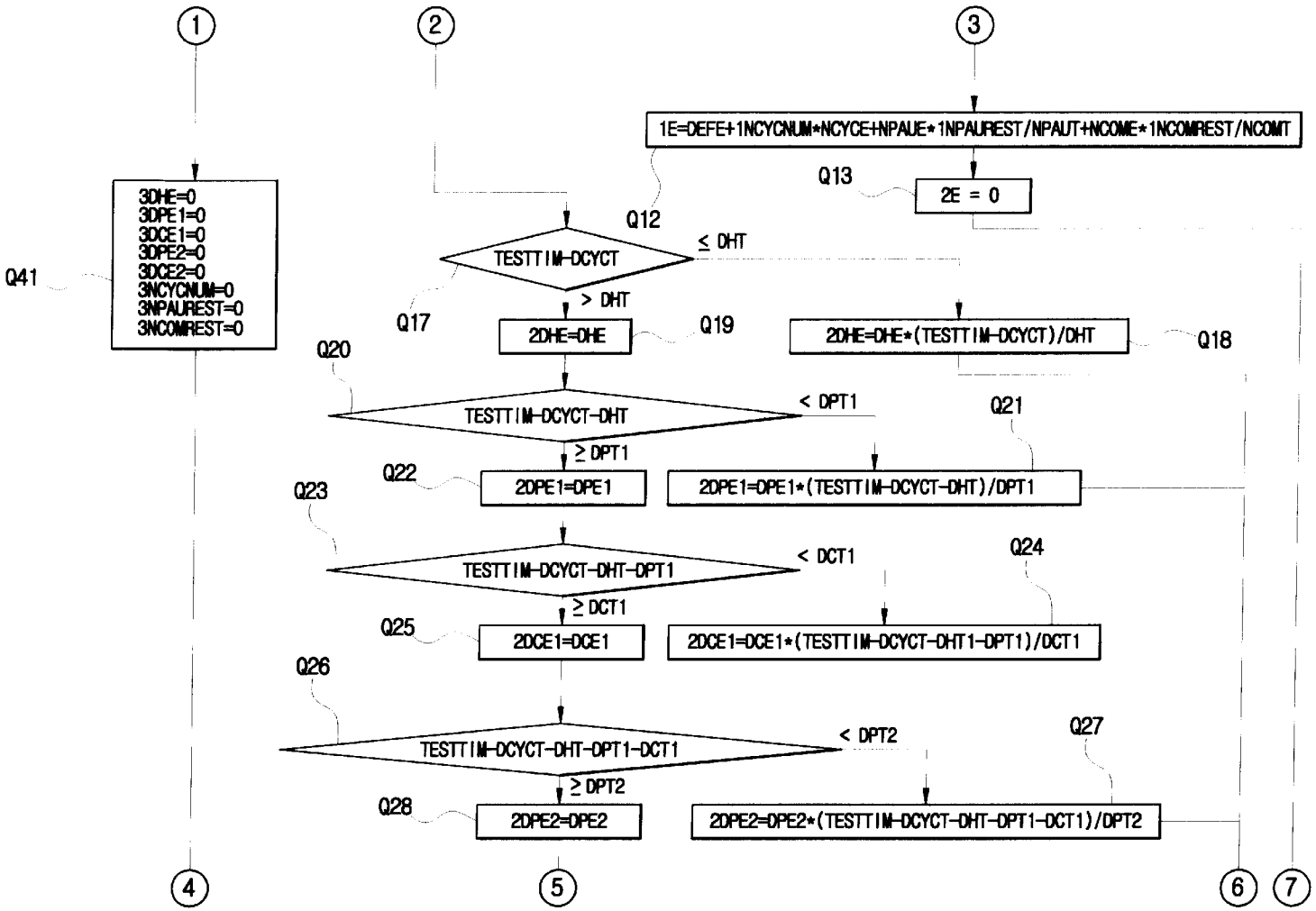
Figure 7C:
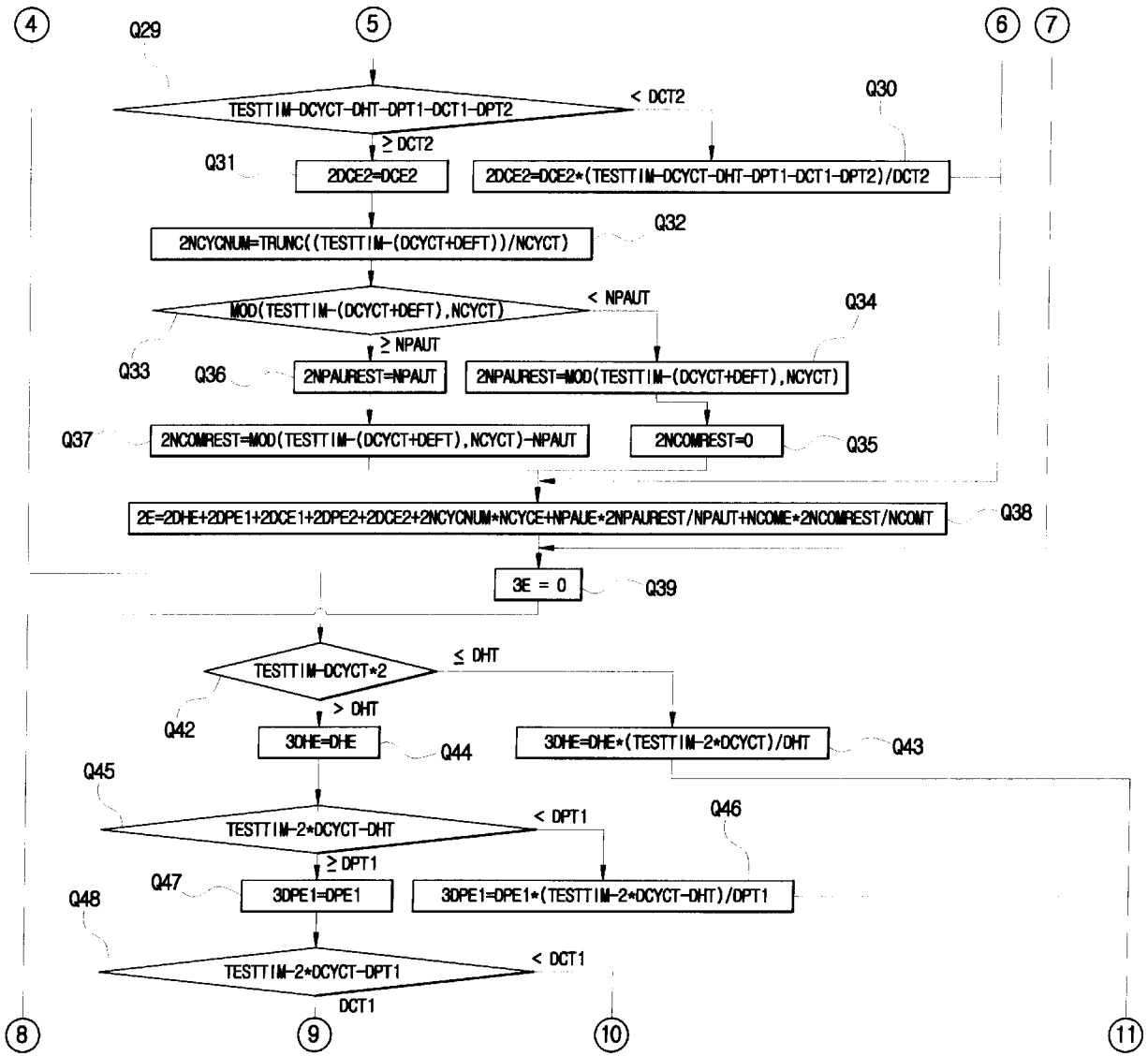
Figure 7D:
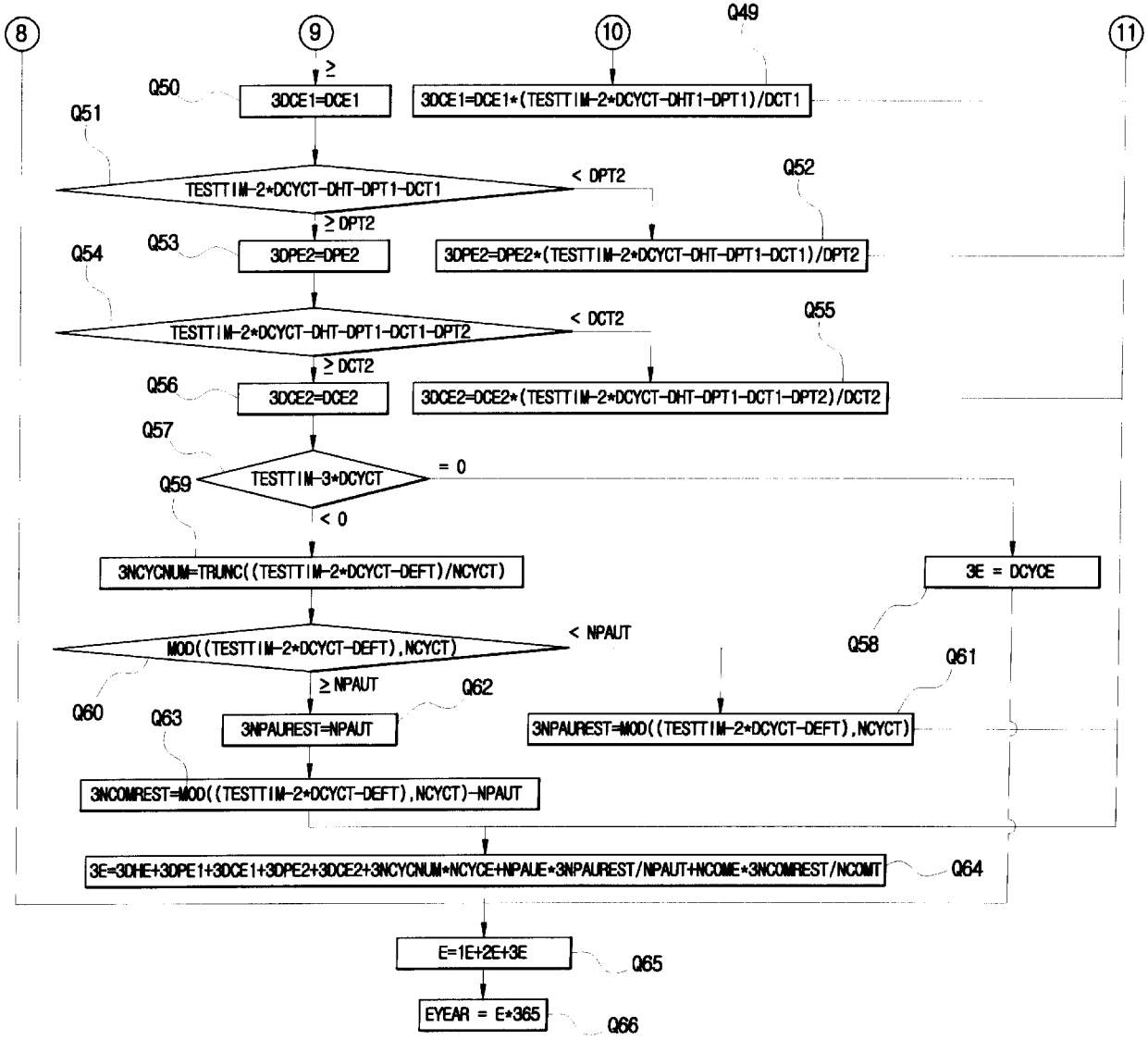

FIG. 5 shows a table showing the results that the power consumption prediction method of the refrigerator according to the present invention is applied to various models.

As shown in the table of FIG. 5, based on the results according to the KS power consumption testing regulations, it can be seen that an accuracy of the power consumption prediction results of the refrigerator according to the present invention is close to 100%.

FIG. 6 is a graphical view showing an accuracy of power consumption prediction results of the refrigerator according to the present invention in comparison with the power consumption testing results on the basis of the KS Regulations.

As shown in the graph of FIG. 6, ten samples each show the accuracy close to 100%.

Thus, the power consumption prediction method of the refrigerator according to the present invention, can obtain the substantially same results as the full-time measuring test results based on the conditions and methods according to the KS Regulations, only with actual measurement results of a short-time (about six hours or so).

In the following, a power consumption prediction method and apparatus consistent with the U.S. Regulations will be described as another embodiment of the present invention.

The power consumption prediction apparatus according to another embodiment of the present invention has the same constructional elements as those of the former embodiment of the present invention. Thus, as shown in FIG. 1, the power consumption prediction apparatus according to this embodiment of the present invention includes a compressor 3, a defrosting heater 5, a controller 1, a time detector 7, an energy measuring unit 9 and an energy consumption calculator 11.

The sequence of the power consumption prediction method according to this embodiment of the present invention is the same as that of the former embodiment of the present invention. Only a difference resides in the fact that this embodiment is performed under the conditions according to the U.S. Regulations. The power consumption test on refrigerators to be sold in the U.S.A., shall be performed under the conditions consistent with the U.S. Regulations. By doing so, the test results are legally admitted. Thus, if the U.S. Regulations are altered, the present testing can be adjusted according to the altered Regulations. In accordance with the U.S. Standard Energy Testing Regulations, temperature control buttons for a freezing chamber and a cooling chamber each are set "Low" mode. Then the refrigerator is run and reaches the stable state. Thereafter, the present embodiment will be executed. Here, before executing the test according to the present invention, the temperatures of the freezing chamber and the cooling chamber are measured. If the measured temperatures exceed predetermined temperatures, respectively (in which under the U.S. Standard Energy Testing Regulations, the cooling chamber temperature is 7.2° C. or less and the freezing chamber temperature is −15° C. or less;), the temperature control buttons in the freezing chamber and the cooling chamber are set again "High" modes, and then test is started. Thus, as shown in FIG. 2, the defrosting timer cycle (DEFTIMER) of the refrigerator is set (P1). In the refrigerator having an automatic defrosting function, a predetermined defrosting timer cycle has been input in advance. Thus, the defrosting timer cycle is set the preset defrosting timer cycle.

Then, a test run is executed in order to predict power consumption in a power consumption prediction apparatus for a refrigerator according to another embodiment of the present invention (P2). A test run interval in order to predict power consumption according to another embodiment of the present invention, and operation characteristics of the defrosting heater 5 and the compressor 3 in the test run interval are the same as those according to the former embodiment of the present invention. The consumed energy in the defrosting effect interval does not have a constant period and is irregular. Meanwhile, a normal interval following the defrosting effect interval is an interval where a cooling cycle is started and completed three times, in which the regular energy consumption is shown with a constant period.

During these times of operation and pause of the compressor 3, and defrosting heater 5, the time detector 7 detects defrosting time DHT, operation times, and pause times in the defrosting effect interval(DPT1, DCT1, DPT2, DCT2), and operation times, and pause times in the normal interval (NPT4, NCT4, NPT5, NCT5), and the energy measuring unit 9 detects the power consumption of the refrigerator during those respective times as mentioned above, that is, the defrosting energy DHE during the defrosting time DHT, the first pause energy DPE1 during the first pause time DPT1, the first operation energy DCE1 during the first operation time DCT1, the second pause energy DPE2 during the second pause time DPT2, the second operation energy DCE2 during the second operation time DCT2, the fourth pause energy NPE4 during the fourth pause time NPT4, the fourth operation energy NCE4 during the fourth operation time NCT4, the fifth pause energy NPE5 during the fifth pause time NPT5, and the fifth operation energy NCE5 during the fifth operation time NCT5. In units of measurement, a time unit is minute (min) and an energy unit is watthour (Wh).

In the test, it takes about six hours in average, when a general operation time of the defrosting heater and the pause and operation times of the compressor in the defrosting effect interval and the normal interval are taken into consideration. And, the actual energy consumed in the refrigerator for a reference prediction unit time according to the KS power consumption testing method can be predicted based on each value obtained by the above-described test without actually measuring the energy consumption.

If the above test is completed, a unit run cycle (DCYCT) of the refrigerator corresponding to a defrosting timer cycle (DEFTIMER) is estimated based on each detected time value (P4 of FIG. 2).

To estimate a unit run cycle (DCYCT), it requires for obtaining the following values based on each time value. The values to be obtained are a defrosting effect interval (DEFT), a normal cycle (NCYCT) meaning a cooling cycle during the normal interval, a normal operation time (NCOMT) meaning an operation time of the compressor 3 during the normal interval, a normal pause time (NPAUT) meaning a pause time of the compressor 3 during the normal interval, the number of normal cycle times (NCYCNUM) of the unit run cycle (DCYCT), and a normal operation remaining interval (NCOMREST) meaning the operation time of the compressor which does not exert a normal operation time (NCOMT) which are the same as those in the former embodiment. These are obtained by the following equations (101) through (106)

DEFT=SUM(DHT, DPT1, DCT1, DPT2, DCT2) (101)

NCYCT=SUM(NPT4, NCT4, NPT5, NCT5)/2 (102)

NCOMT=AVERAGE(NCT4, NCT5) (103)

NPAUT=AVERAGE(NPT4, NPT5) (104)

NCYCNUM=TRUNC((DEFTIMER−DCT1−DCT2)/NCOMT)(105)

NCOMREST=MOD(DEFTIMER−DCT1−DCT2, NCOMT) (106)

Thus, the unit operation period(DCYCT) is:

DCYCT=SUM(DEFT, NCYCNUM*NCYCT, NPAUT, NCOMREST) (107)

Then, based on the measured values of the energy measuring unit 9, a defrosting effect interval energy (DEFE) being the energy consumed during the defrosting effect time (DEFT), a normal cycle energy (NCYCE) being the energy consumed during the normal cycle (NCYCT), a normal pause energy (NPAUE) being the energy consumed during the normal pause time (NPAUT), and a normal operation energy (NCOME) being the energy consumed during the normal operation time (NCOMT) are obtained by the following equations (108) through (111) (P5 of FIG. 2).

DEFE=SUM(DHE, DPE1, DCE1, DPE2, DCE2) (108)

NCYCE=SUM(NPE4, NPE5, NCE4, NCE5) (109)

NPAUE=AVERAGE(NPE4, NPE5) (110)

NCOME=AVERAGE(NCE4, NCE5) (111)

Thus, all the values necessary for prediction of the power consumption can be seen. As a result, the energy consumed is estimated on the basis of each value obtained by the above equations (P5 of FIG. 2), to then complete the power consumption prediction for the refrigerator.

FIGS. 7*a*, 7*b*, 7*c*, and 7*d* are flowchart views illustrating processes for estimating the energy consumption according to the present invention. Hereinafter, the process for evaluating the power consumption of the refrigerator will be explained in more detail. Referring to FIGS. 7*a*, 7*b*, 7*c*, and 7*d*, the energy consumption estimation is limited to the case that at maximum three defrosting effect intervals exist within a predetermined reference prediction unit time, that is, three unit run cycles of the refrigerator are included therein at the longest (TESTTIM=3 * DCYCT).

Thus, in the case that a fourth defrosting effect interval is progressed within the reference prediction unit time, the contents in the flowchart view should be added in the same manner. However, considering that a compressor running ratio is 40–50% although the defrosting timer cycle is set 6 hours, comparatively a short time, the fourth defrosting effect interval may not exist actually in the reference prediction unit time.

Referring back to FIGS. 7*a* through 7*d*, in order to better understand the power consumption prediction method according to one embodiment of the present invention, the values of the measured testing results are set initial values (Q1), based on which the step (Q2) of obtaining the values necessary for the power consumption prediction according to the equations as described above is included.

The energy consumption of the unit run cycle (DCYCT) of the refrigerator which has been consumed from the time when forced defrosting is performed till before the initial automatic defrosting is performed, that is, a first unit run energy (1E) is summed according to the following equation (Q3).

DCYCE=DEFE+NCYCNUM*NCYCE+NPAUE+NCOME*NCOMREST/NCOMT (112)

Here the term NCYCNUM * NCYCE+NPAUE represents the normal run energy of the refrigerator during the normal interval, and the term NCOME * NCOMREST/NCOMT represents the energy consumption of the refrigerator during the remaining interval which does not exert the normal cycle.

Next, the reference prediction unit time(TESTTIME) is set 24 hours(Q4). The reason why the reference prediction unit time (TESTTIM) is set 24 hours based on the completion point in time of the initial automatic defrosting following the forced defrosting resides in the testing conditions in the US power consumption prediction method. In the case of the power consumption prediction method according to the embodiment of the present invention, the reason is to show that the substantially same results can be obtained without performing an actual time test (24 hours) according to the current US power consumption quantity test conditions. Thus, if such conditions are altered, the power consumption prediction method according to one embodiment of the present invention should be adjusted properly.

Thus, the energy consumption in the refrigerator during the first, the second, and the third unit run cycles (1E, 2E, 3E) included in the reference prediction unit time (TESTTIME), where the unit run cycle (DCYCT) might be included totally or partially, is predicted on the basis of the energy consumption in the refrigerator during the unit run cycle(DCYCE), and then each unit energy value (1E, 2E, 3E) is summed to obtain the energy consumption (E) consumed in the refrigerator during the reference prediction unit time (e.g., E=1E+2E+3E). Based on the energy consumptions (E) consumed in the refrigerator during the reference prediction unit time, the yearly and the monthly power consumptions of the refrigerator are calculated.

According to the unit run cycle (DCYCT), it is possible that 2E and 3E are zero, or that 3E is zero because it is a possible that the second and the third unit run cycle are not included in the reference prediction unit time, or that the third unit run cycle is not included in the reference prediction unit time.

Hereinafter, the steps of calculating the energy consumption of the refrigerator during the first, the second, and the third unit run cycles (1E, 2E, 3E) will be explained in more detail. Here, in the process of calculating the consumed energy (1E, 2E, 3E) the meaning of each variable is the same as those of the previous ones, in which the numbers 1, 2, and 3 in front of each variable are not coefficients, but indicate respectively variables for obtaining first, second, third unit run energies (1E, 2E, 3E).

It is judged whether or not the unit run cycle is completed in the reference prediction unit time, that is, whether or not the unit run cycle is longer than the reference prediction unit time (Q5).

In the case the unit run cycle is equal to or shorter than the reference prediction unit time, which means that the unit run cycle is not completed in the reference prediction unit time, only the first unit run energy(1E) is calculated through following steps based on the energy consumption in the refrigerator during the unit run cycle (DCYCE).

The number of normal cycle times of the unit run cycle (1NCYCNUM) is calculated through following equation (113)(Q6).

1NCYCNUM=TRUNC((TESTTIM−DEFT)/NCYCT) (113)

Next, it is judged whether or not the rest of normal cycle, or MOD(TESTTIM−DEFT), NCYCT) is longer than the normal pause time(NPAUT) (Q7).

In the case MOD(TESTTIM−DEFT), NCYCT) is equal to or shorter than the normal pause time(NPAUT), which means that the reference prediction unit time is completed when the normal pause time(NPAUT) in the period of normal cycle(NCYCT) is in progress, the first normal pause remaining interval (1NPAUREST) as the normal remaining interval is (Q8):

$$1NPAUREST=MOD((TESTTIM-DEFT), NCYCT) \quad (114).$$

And a normal operation remaining interval (1NCOMREST) as the rest of the normal cycle is zero (Q9). Thus the first unit run energy(1E) is (Q12):

$$1E=DEFE+1NCYCNUM*NCYCE+NPAUE*1NPAUREST/NPAUT(Q12) \quad (115)$$

because $$1E=DEFE+1NCYCNUM*NCYCE+NPAUE*1NPAUREST/NPAUT+NCOME*1NC\ OMREST/NCOMT \quad (115)$$

In the case MOD(TESTTIM−DEFT), NCYCT) is longer than the normal pause time (NPAUT) (Q7), which means that the reference prediction unit time is completed in the case normal operation time (NCOMT) in the period of normal cycle (NCYCT) is in progress, the rest of the normal pause time(1NPAUREST) as the normal remaining interval (Q1O):

$$1NPAUREST=NPAUT \quad (117)$$

And the first normal operation remaining interval (1NCOMREST) as the rest of the normal cycle is (Q11):

$$MOD(TESTTIM-DEFT, NCYCT)-NPAUT \quad (118).$$

Thus the first unit run energy (1E) is:

$$1E=DEFE+1NCYCNUM*NCYCE+NPAUE*1NPAUREST/NPAUT+NCOME*1NC\ OMREST/NCOMT(Q12) \quad (116).$$

And the second and the third unit run energies (2E, 3E) are respectively zero (Q13, Q39); consequently the energy consumption (E) consumed in the refrigerator during the reference prediction unit time is calculated (Q65).

In the case the unit run cycle is longer than the reference prediction unit time, which means that the unit run cycle is completed in the reference prediction unit time, the first unit run energy (1E) is (Q14):

$$1E=DCYCE \quad (119).$$

Next, it is judged whether or not the unit run cycle is included more than twice in the reference prediction unit time (Q15). That is, it is judged whether or not the reference prediction unit time is longer than double the unit run cycle.

In the case the reference prediction unit time is equal to or shorter than double the unit run cycle, the consumed energy during the second unit run cycle (DCYCT) partially included in the reference prediction unit time (TESTTIM) varies according to whether or not the defrosting effect interval and the normal cycle of the second unit run energy (DCYCT) is included, that is, according to the length of the second unit run cycle (DCYCT) included in the reference prediction unit time (TESTTIM) which is a value by subtracting the unit run cycle (DCYCT) from the reference prediction unit time (TESTTIM). First, the values necessary for obtaining the consumed energy of the second unit run cycle, that is, the energy consumed during the defrosting time (2DHE), the energy consumed during the first pause time (2DPE1) in the defrosting effect interval, the energy consumed during the first operation time (2DCE1), the energy consumed during the second pause time (2DPE2), the energy consumed during the second operation time (2DCE2), the normal cycle number of times (2NCYCNUM) in the normal interval, the normal pause remaining interval (2NPAUREST) and the normal operation remaining interval (2NCOMREST) are all set zero (0) (Q16). In the case that there exists at least one non-zero value among the above values according to the length of the unit run cycle (DCYCT) included in the reference prediction unit time (TESTTIM), the value is altered into a corresponding value, to thus be calculated to the consumed energy (2E).

Hereinafter, the consumed energy of the second unit run cycle included in the reference prediction unit time, that is, the second unit run energy (2E) will be explained in more detail.

First, it is judged whether or not the value by subtracting the unit run cycle from the reference prediction unit time is equal to, or shorter than the defrosting time(DHT) (Q17).

In the case the value by subtracting the unit run cycle from the reference prediction unit time is equal to, or shorter than the defrosting time(DHT), the energy consumed during the defrosting time (2DHE) is (Q18):

$$2DHE=DHE*(TESTTIM-DCYCT)/DHT \quad (120)$$

Thus all the values for prediction of the second unit run energy (2E) included in the reference prediction unit time can be seen, and 2E is (Q38):

$$2E=2DHE \quad (121)$$

because $$2E=DEFE+2NCYCNUM*NCYCE+NPAUE*2NPAUREST/NPAUT+NCOME*2NC\ OMREST/NCOMT \quad (122),$$

and the consumed energy of the third unit run cycle included in the reference prediction unit time(3E) is zero (Q39), consequently the energy consumption (E) consumed in the refrigerator during the reference prediction unit time being calculated (Q(35).

In the case the value by subtracting the unit run cycle from the reference prediction unit time is longer than the defrosting time (DHT) (Q17), the defrosting energy 2DHE during the defrosting time DHT is (Q19):

$$2DHE=DHE \quad (123),$$

and it is judged whether or not TESTTIM−DCYCT−DHT is shorter than the first pause time (DPT1) (C)20).

In the case TESTTIM−DCYCT−DHT is shorter than the first pause time (DPT1), the first pause energy 2DPE1 during the first pause time DPT1 is (Q21):

$$2DPE1=DPE1*(TESTTIM-DCYCT-DHT)/DPT1 \quad (124).$$

Thus all the values for prediction of the second unit run energy (2E) included in the reference prediction unit time can be seen, and 2E is (Q38):

$$2E=DHE+2DPE1 \quad (125),$$

because $$2E=DEFE+2NCYCNUM*NCYCE+NPAUE*2NPAUREST/NPAUT+NCOME*2NC\ OMREST/NCOMT \quad (122),$$

and the consumed energy of the third unit run cycle included in the reference prediction unit time (3E) is zero (Q39), consequently the energy consumption (E) consumed in the refrigerator during the reference prediction unit time being calculated (Q65).

In the case TESTTIM−DCYCT−DHT is equal to or longer than the first pause time (DPT1) (Q20), the energy consumed during the first pause time (2DPE1) in the defrosting effect interval is (Q22):

2DPE1=DPE1 (126), and it is judged whether or not TESTTIM−DCYCT−DHT−DPT1 is shorter than the first operation time(DCT1) (Q23).

In the case TESTTIM−DCYCT−DHT−DPT1 is shorter than the first operation time (DCT1), the energy consumed during the first operation time (2DCEl) is (Q24):

2DCE1=DCE1*(TESTTIM−DCYCT−DHT−DPT1)/DCT1 (127).

Thus all the values for prediction of the second unit run energy (2E) included in the reference prediction unit time can be seen, and 2E is (Q38):

2E=2DHE+2DPE1+2DCE1 (128), because

2E=DEFE+2NCYCNUM*NCYCE+NPAUE*2NPAUREST/NPAUT+NCOME*2NC OMREST/NCOMT (122), and the consumed energy of the third unit run cycle included in the reference prediction unit time(3E) is zero(Q39), consequently the energy consumption (E) consumed in the refrigerator during the reference prediction unit time being calculated (Q65).

In the case TESTTIM−DCYCT−DHT−DPT1 is equal to or longer than the first operation time(DCT1)(Q23), the power consumption of the refrigerator during the first operation time(2DCE1) is(Q25):

2DPE1=DPE1 (129), and it is judged whether or not TESTTIM−DCYCT−DHT−DPT1−DCT1 is shorter than the second pause time(DPT2) (Q26).

In the case TESTTIM−DCYCT−DHT−DPT1−DCT1 is shorter than the second pause time(DPT2), the energy consumed during the second pause time (2DPE2) is (Q27):

2DPE2=DPE2*(TESTTIM−DCYCT−DHT−DPT1−DCT1)/DPT2 (130).

Thus all the values for prediction of the second unit run energy (2E) included in the reference prediction unit time can be seen, and 2E is (Q39):

2E=2DHE+2DPE1+2DCE1+2DPE2 (131), because

2E=DEFE+2NCYCNUM*NCYCE+NPAUE*2NPAURESTINPAUT+NCOME*2NC OMREST/NCOMT (122), and the consumed energy of the third unit run cycle included in the reference prediction unit time (3E) is zero (Q39), consequently the energy consumption (E) consumed in the refrigerator during the reference prediction unit time being calculated (Q65).

In the case TESTTIM−DCYCT−DHT−DPT1−DCT1 is equal to or longer than the second pause time (DPT2) (Q26), the energy consumed during the second pause time (2DPE2) is (Q28):

2DPE2=DPE2 (132), and it is judged whether or not TESTTIM−DCYCT−DHT−DPT1−DCT1−DPT2 is shorter than the second operation time (DCT2) (Q29).

In the case TESTTIM−DCYCT−DHT−DPT1−DCT1−DPT2 is shorter than the second operation time (DCT2), the energy consumed during the second operation time (2DCE2) is (Q30):

2DCE2=DCE2*(TESTTIM−DCYCT−DHT−DPT1−DCT1−DPT2)/DCT2 (133).

Thus all the values for prediction of the second unit run energy (2E) included in the reference prediction unit time can be seen, and 2E is (Q38):

2E=2DHE+2DPE1+2DCE1+2DPE2+2DCE2 (134), because

2E=DEFE+2NCYCNUM*NCYCE+NPAUE*2NPAUREST/NPAUT+NCOME*2NC OMREST/NCOMT (122), and the consumed energy of the third unit run cycle included in the reference prediction unit time (3E) is zero (Q39), consequently the energy consumption (E) consumed in the refrigerator during the reference prediction unit time being calculated (Q65).

In one case TESTTIM−DCYCT−DHT−DPT1−DCT1−DPT2 is equal to or longer than the second operation time (DCT2) (Q29), the energy consumed during the second operation time (2DCE2) is (Q31):

2DPE2=DPE2 (135), and, a second normal cycle number of times (2NCYCNUM) is (Q32):

2NCYCNUM=TRUNC((TESTTIM−(DCYCT+DEFT))/NCYCT) (136), and it is judged whether or not MOD(TESTTIM−(DCYCT+DEFT), NCYCT) is shorter than the normal pause time (NPAUT) (Q33).

In the case MOD(TESTTIM−(DCYCT+DEFT), NCYCT) is shorter than the normal pause time (NPAUT), which means that the reference prediction unit time is completed in the case normal pause time (NPAUT) in the period of normal cycle (NCYCT) is in progress, the second normal pause remaining interval (2NPAUREST) as the normal remaining interval, is (Q34):

2NPAUREST=MOD(TESTTIM−(DCYCT+DEFT), NCYCT)(137).

And the second normal operation remaining interval (2NCOMREST) as the normal remaining interval is (Q35):

2NCOMREST=0 (138).

Thus all the values for prediction of the second unit run energy (2E) included in the reference prediction unit time can be seen, and 2E is (Q38):

2E=DEFE+2NCYCNUM*NCYCE+NPAUE*2NPAUREST/NPAUT (139)

because

2E=DEFE+2NCYCNUM*NCYCE+NPAUE*2NPAUREST/NPAUT+NCOME*2NC OMREST/NCOMT (122), and the consumed energy of the third unit run cycle included in the reference prediction unit time (3E) is zero (Q39), consequently the energy consumption (E) consumed in the refrigerator during the reference prediction unit time being calculated (Q65).

In the case MOD(TESTTIM−(DCYCT+DEFT), NCYCT) is equal to or longer than the normal pause time (NPAUT), which means that the reference prediction unit time is completed in the case normal operation time (NCOMT) in the period of normal cycle (NCYCT) is in progress, the second normal pause remaining interval (2NPAUREST) as the rest of the normal cycle is (Q36):

$$2NPAUREST=NPAUT \quad (140).$$

And the second normal operation remaining interval (2NCOMREST) as the rest of the normal cycle is (Q37):

$$2NCOMREST=MOD(TESTTIM-(DCYCT+DEFT), NCYCT)-NPAUT \quad (141).$$

Thus all the values for prediction of the second unit run energy (2E) included in the reference prediction unit time can be seen, and 2E is (Q38):

$$2E=DEFE+2NCYCNUM*NCYCE+NPAUE*2NPAUREST/NPAUT+NCOME*2NC\ OMREST/NCOMT \quad (122),$$

and the consumed energy of the third unit run cycle included in the reference prediction unit time (3E) is zero (Q39), consequently the energy consumption (E) consumed in the refrigerator during the reference prediction unit time being calculated (Q65).

In the case the reference prediction unit time is longer than double the unit run cycle (Q15), which means that the second unit run cycle is totally included in the reference prediction unit time, and the third unit run cycle is totally or partially included in the reference prediction unit time. Thus, the consumed energy of the second unit run cycle included in the reference prediction unit time, that is, the second unit run energy (2E) can be estimated to be the same as the first unit run energy (1E) based on the fact that the energy consumption of the refrigerator has a constant periodicity, as described with reference to FIG. 3. Accordingly, the following equation (142) is met (Q40).

$$2E=1E \quad (142)$$

The consumed energy during the third unit run cycle (DCYCT) included in the reference prediction unit time (TESTTIM) varies according to whether or not the defrosting effect interval and the normal cycle of the third unit run energy (DCYCT) is included, that is, according to the length of the third unit run cycle (DCYCT) included in the reference prediction unit time (TESTTIM) which is a value by subtracting the value double the unit run cycle (DCYCT) from the reference prediction unit time (TESTTIM). Thus, as described above, the values necessary for obtaining the consumed energy of the third unit run cycle, that is, the energy consumed during the defrosting time (3DHE), the energy consumed during the first pause time (3DPE1) in the defrosting effect interval, the energy consumed during the first operation time (3DCE1), the energy consumed during the second pause time (3DPE2), the second operation time. (3DCE2), the normal cycle number of times (3NCYCNUM) in the normal interval, the normal pause remaining interval (3NPAUREST) and the normal operation remaining interval (3NCOMREST) are all set zero (0) (Q41). In the case that there exists at least one non-zero value among the above values according to the length of the unit run cycle (DCYCT) included in the reference prediction unit time (TESTTIM), the value is altered into a corresponding value, to thus be calculated to the consumed energy (3E).

Hereinafter, the consumed energy of the third unit run cycle included in the reference prediction unit time, that is, the third unit run energy (3E) will be explained in more detail.

First, it is judged whether or not the value by subtracting double the unit run cycle from the reference prediction unit time is equal to, or shorter than the defrosting time (DHT) (Q42).

In the case the value by subtracting double the unit run cycle from the reference prediction unit time is equal to, or shorter than the defrosting time (DHT), the energy consumed during the defrosting time (3DHE) is (Q43):

$$3DHE=DHE*(TESTTIM-2*DCYCT)/DHT \quad (143).$$

Thus all the values for prediction of the third unit run energy (3E) included in the reference prediction unit time can be seen, and 3E is (Q64):

$$3E=3DHE \quad (144)$$

because $$3E=3DHE+3DPE1+3DCE1+3DPE2+3DCE2+3NCYCNUM*NCYCE+NPAUE*3NP\ AUREST/NPAUT+NCOME*3NCOMREST/NCOMT \quad (164).$$

In the case the value by subtracting double the unit run cycle from the reference prediction unit time is longer than the defrosting time (DHT) (Q42), the energy consumed during the defrosting time (3DHE) is (Q44):

$$3DHE=DHE \quad (145),$$

and it is judged whether or not TESTTIM−2 * DCYCT−DHT is shorter than the first pause time (DPT1) (Q45).

In the case TESTTIM−2 * DCYCT−DHT is shorter than the first pause time (DPT1), the energy consumed during the first pause time (3DPE1) in the defrosting effect interval is (Q46):

$$3DPE1=DPE1*(TESTTIM-2*DCYCT-DHT)/DPT1 \quad (146).$$

Thus all the values for prediction of the third unit run energy (3E) included in the reference prediction unit time can be seen, and 3E is (Q64):

$$3E=3DHE+3DPE1 \quad (147)$$

because $$3E=3DHE+3DPE1+3DCE1+3DPE2+3DCE2+3NCYCNUM*NCYCE+NPAUE*3NP\ AUREST/NPAUT+NCOME*3NCOMREST/NCOMT \quad (164).$$

In the case TESTTIM−2 * DCYCT−DHT is equal to, or longer than the first pause time (DPT1) (Q45), the energy consumed during the first pause time (3DPE1) in the defrosting effect interval is (Q47):

$$3DPE1=DPE1 \quad (148),$$

and it is judged whether or not TESTTIM−2 * DCYCT−DHT−DPT1 is shorter than the first operation time (DCT1) (Q48).

In the case TESTTIM−2 * DCYCT−DHT−DPT1 is shorter than the first operation time (DCT1), the energy consumed during the first operation time (3DCE1) is (Q49):

$$3DCE1=DCE1*(TESTTIM-2*DCYCT-DHT-DPT1)/DCT1 \quad (149).$$

Thus all the values for prediction of the third unit run energy (3E) included in the reference prediction unit time can be seen, and 3E is (Q64):

$$3E=3DHE+3DPE1+3DCE1 \quad (150)$$

because

3E=3DHE+3DPE1+3DCE1+3DPE2+3DCE2+3NCYCNUM*NCYCE+NPAUE*3NP AUREST/NPAUT+NCOME*3NCOMREST/NCOMT (164).

In the case TESTTIM−2 * DCYCT−DHT−DPT1 is equal to, or longer than the first operation time (DCT1) (Q48), the energy consumed during the first operation time (3DCE1) is (Q50):

3DCE1=DCE1 (151), and it is judged whether or not TESTTIM−2 * DCYCT−DHT−DPT1−DCT1 is shorter than the second pause time (DPT2) (Q51).

In the case TESTTIM−2 * DCYCT−DHT−DPT1−DCT1 is shorter than the second pause time (DPT2), the energy consumed during the second pause time (3DPE2) is (Q52):

3DPE2=DPE2*(TESTTIM−2*DCYCT−DHT−DPT1+DCT1)/DPT2 (152).

Thus all the values for prediction of the third unit run energy (3E) included in the reference prediction unit time can be seen, and 3E is (Q64):

3E=3DHT+3DPE1+3DCE1+3DPE2 (153)

because

3E=3DHE+3DPE1+3DCE1+3DPE2+3DCE2+3NCYCNUM*NCYCE+NPAUE*3NP AUREST/NPAUT+NCOME*3NCOMREST/NCOMT (164).

In the case TESTTIM−2 * DCYCT−DHT−DPT1−DCT1 is equal to, or longer than the second pause time (DPT2) (Q51), the energy consumed during the second pause time (3DPE2) is (Q53):

3DPE2=DPE2 (154), and it is judged whether or not TESTTIM−2 * DCYCT−DHT−DPT1−DCT1−DPT2 is shorter than the second operation time (DCT2) (Q54).

In the case TESTTIM−2 * DCYCT−DHT−DPT1−DCT1−DPT2 is shorter than the second operation time (DCT2), the second operation time (3DCE2) is (Q55):

3DCE2=DCE2*(TESTTIM−2*DCYCT−DHT−DPT1−DCT1−DPT2)/DCT2 (155).

Thus all the values for prediction of the third unit run energy (3E) included in the reference prediction unit time can be seen, and 3E is (Q64):

3E=3DHE+3DPE1+3DCE1+3DPE2+3DCE2 (156), because

3E=3DHE+3DPE1+3DCE1+3DPE2+3DCE2+3NCYCNUM*NCYCE+NPAUE*3NP AUREST/NPAUT+NCOME*3NCOMREST/NCOMT (164).

In the case TESTTIM−2 * DCYCT−DHT−DPT1−DCT1−DPT2 is equal to, or longer than the second operation time(DCT2)(Q54), the second operation time (3DCE2) is (Q56):

3DCE2=DCE2 (157), and it is judged whether or not TESTTIM−3 * DCYCT is equal to, or less than zero (Q57). The term TESTTIM−3 * DCYCT cannot be larger than zero, because, as described above and as shown in FIGS. 7*a*, 7*b*, 7*c*, and 7*d*, the present flowchart is limited to the case that the third defrosting effect interval is included in the reference prediction unit time (DCYCT).

In the case TESTTIM−3 * DCYCT is equal to zero, the following equation (158) is met (Q58).

3E=DCYCE (158)

In the ease TESTTIM−3 * DCYCT is less than zero(Q57), the following equation (159) is met (Q59).

3NCYCNUM=TRUNC((TESTTIM−2*DCYCT−DEFT)/NCYCT) (159), and it is judged whether or not MOD((TESTTIM−2 * DCYCT−DEFT), NCYCT) is shorter than the normal pause time (NPAUT) (Q60).

In the case MOD((TESTTIM−2 * DCYCT−DEFT), NCYCT) is shorter than the normal pause time (NPAUT), the normal pause remaining interval (3NPAUREST) as the rest of the normal cycle, is (Q61):

3NPAUREST=MOD((TESTTIM−2*DCYCT−DEFT), NCYCT) (160).

Thus all the values for prediction of the third unit run energy (3E) included in the reference prediction unit time can be seen, and 3E is (Q64):

3E=3DHE+3DPE1+3DCE1+3DPE2+3DCE2+3NCYCNUM*NCYCE+NPAUE*3NPAUREST/NPAUT (161), because 3E=3DHE+3DPE1+3DCE1+3DPE2+3DCE2+3NCYCNUM*NCYCE+NPAUE*3NP AUREST/NFAUT+NCOME*3NCOMREST/NCOMT (164).

In the case MOD((TESTTIM−2 * DCYCT−DEFT), NCYCT) is equal to, or longer than the normal pause time (NPAUT) (Q60), the normal pause remaining interval (3NPAUREST) as the normal remaining interval, is (Q62):

3NPAUREST=NPAUT (162), and the normal operation remaining interval (3NCOMREST) as the normal remaining is (Q63):

3NCOMREST=MOD(TESTTIM−2*DCYCT−DEFT, NCYCT)−NPAUT (163).

Thus, the third unit run energy (3E) is (Q64):

3E=3DHE+3DPE1+3DCE1+3DPE2+3DCE2+3NCYCNUM*NCYCE+NPAUE*3NP AUREST/NPAUT+NCOME*3NCOMREST/NCOMT (164).

Therefore, the energy (E) consumed in the refrigerator during the reference prediction unit time (TESTTIM) is sum of 1E, 2E, and 3E (Q65), and the yearly energy consumption in the refrigerator (EYEAR) is (Q66):

EYEAR=E*365 (165).

Thus, the power consumption prediction method of the refrigerator according to the present invention, can yield the substantially same results as the long-time measuring test results based on the conditions and methods according to the U.S. Regulations, only with actual measurement results of a short-time (about six hours or so).

As described above, a method and an apparatus for predicting power consumption of a refrigerator having a defrosting heater according to the present invention yield the substantially same results as the long-time measuring test results based on the conditions and methods according to the U.S. and KS Regulations, with only actual measurement results of a short-time (about six hours or so).

Although the present invention has been described in connection with preferred embodiments thereof, it will be appreciated by those skilled in the art that additions, modifications, substitutions and deletions not specifically described may be made without departing from the spirit and scope of the invention as defined in the appended claims.

What is claimed is:

1. A power consumption prediction method for a refrigerator having a compressor, an evaporator and a defrosting heater for removing frost built up on the evaporator, the power consumption prediction method comprising the steps of:

setting a defrosting timer cycle expressed as a cumulative value of an operation time of the compressor;

enabling the defrosting heater to operate to perform forced defrosting, and measuring a defrosting time and a defrosting energy;

performing a cooling cycle including a pause and an operation of the compressor several times, and measuring the pause time and the operation time of the compressor and the energy consumed during the pause time and the operation time of the compressor;

estimating a unit run cycle of the refrigerator corresponding to the defrosting timer cycle based on the defrosting time, the pause time and the operation time; and estimating the energy consumed during a predetermined time.

2. The power consumption prediction method according to claim 1, wherein said unit run cycle estimation step comprises the sub-steps of:

segmenting an interval into a defrosting effect interval including the forced defrosting and at least one cooling cycle following the forced defrosting and a normal interval including at least one cooling cycle following the defrosting effect interval;

obtaining a normal cycle by summing the normal operation time and the normal pause time;

obtaining a normal defrosting timer cycle by subtracting the operation time in the defrosting effect interval from the defrosting timer cycle;

obtaining a normal cycle number of times of the compressor by dividing the normal defrosting timer cycle by the normal operation time;

calculating a normal run time of the compressor by summing the value obtained by multiplying the normal cycle by the normal operation time and the normal pause time; and calculating the unit run cycle by summing the time of the defrosting effect interval and the normal operation time.

3. The power consumption prediction method according to claim 2, wherein said sub-step of calculating the normal run time comprises the sub-step of further summing the normal operation remaining interval being the residue which is obtained by dividing the normal defrosting timer cycle by the normal operation time.

4. The power consumption prediction method according to claim 2, wherein said normal operation time is obtained by averaging the operation time of a plurality of cooling cycles during the normal interval, and said normal pause time is obtained by averaging the pause time of a plurality of cooling cycles during the normal interval.

5. The power consumption prediction method according to claim 1, wherein said step of estimating the consumed energy for a predetermined time comprises the sub-steps of:

setting a reference prediction unit time;

calculating a unit run energy;

calculating the energy consumed during at least one unit run cycle in whole or in part included in the reference prediction unit time based on the unit run energy; and summing the energy consumed during at least one unit run cycle in whole or in part included in the reference prediction unit time.

6. The power consumption prediction method according to claim 5, wherein said reference prediction unit time is 24 hours.

7. The power consumption prediction method according to claim 5, wherein said step of setting the reference prediction unit time comprises the sub-steps of:

setting a plurality of prediction unit times;

comparing a sum of the unit run cycle and the defrosting effect interval with said each prediction time; and setting a prediction unit time which is right above the sum of the unit run cycle and the defrosting effect interval as a reference prediction unit time.

8. The power consumption prediction method according to claim 7, wherein said plurality of prediction unit times are 24 hours, 48 hours and 72 hours.

9. The power consumption prediction method according to claim 8, wherein in said reference prediction unit time setting step, said reference prediction unit time is set 72 hours when the sum of the said unit run cycle and said defrosting effect interval exceeds 72 hours.

10. The power consumption prediction method according to claim 5, wherein said step of calculating the unit run energy comprises the sub-steps of:

obtaining a defrosting effect interval energy by summing the defrosting energy and the pause energy and the operation energy during the defrosting effect interval of the compressor;

obtaining a normal cycle energy by summing the normal pause energy and the normal operation energy;

calculating a normal run energy of the compressor by summing the value obtained by multiplying the normal cycle number of times by the normal cycle energy and the normal pause energy; and summing the defrosting effect interval energy and the normal run energy.

11. The power consumption prediction method according to claim 10, wherein said normal pause energy is obtained by averaging the pause energy of a plurality of cooling cycles during the normal interval, and said normal operation energy is obtained by averaging the operation energy of a plurality of cooling cycles during the normal interval.

12. The power consumption prediction method according to claim 10, wherein the normal run energy of the compressor is calculated by further summing the energy consumed during the normal operation remaining interval.

13. The power consumption prediction method according to claim 5, wherein said step of calculating the energy consumed during the at least one unit run cycle which is included in whole or in part in the reference prediction unit time, further comprises the steps of:

estimating whether a defrosting effect remaining interval, the defrosting effect interval starts and is not completed yet, or a normal remaining interval, the normal cycle starts and is not completed yet, exists in the reference prediction unit time based on the unit run cycle of the refrigerator; and wherein the consumed energy during a predetermined time is estimated by further summing the energy consumed during the existing interval when the defrosting effect remaining interval or the normal remaining interval exists.

14. The power consumption prediction method according to claim 13, wherein said step of estimating whether the defrosting effect remaining interval or the normal remaining interval exists, estimates that the defrosting effect remaining interval exists when the remaining interval obtained by dividing the reference prediction unit time by the unit run time of the refrigerator is smaller than the defrosting effect interval, and estimates that the normal remaining interval exists when the remaining interval is larger than the defrosting effect interval.

15. The power consumption prediction method according to claim 13, wherein the energy consumed during the defrosting effect remaining interval is calculated based on the defrosting effect interval energy when the defrosting effect remaining interval exists.

16. The power consumption prediction method according to claim 13, wherein the energy consumed during the normal remaining interval is calculated based on the normal cycle energy when the normal remaining interval exists.

17. A power consumption prediction apparatus for a refrigerator having a compressor, an evaporator and a defrosting heater for removing a layer of frost in the evaporator in which a defrosting timer cycle expressed as a cumulative value of the operation time of the compressor is set in the refrigerator, the power consumption prediction apparatus comprising:

a controller for controlling the defrosting heater to operate to perform forced defrosting and the compressor to perform a cooling cycle including pause and operation several times;

a time detector for detecting a defrosting time of the defrosting heater and the pause and operation times of the compressor;

an energy measuring unit for measuring each energy consumed for the defrosting time, the pause time, and operation time; and an energy consumption calculator for estimating a unit run cycle of the refrigerator corresponding to the defrosting timer cycle based on the detected defrosting time, pause time and operation time, and estimating the energy consumed for a predetermined time.

18. The power consumption prediction apparatus according to claim 17, wherein said energy consumption calculator performs the steps of:

segmenting an interval into a defrosting effect interval including the forced defrosting and at least one cooling cycle following the forced defrosting and a normal interval including at least one cooling cycle following the defrosting effect interval;

obtaining a normal cycle by summing the normal operation time and the normal pause time;

obtaining a normal defrosting timer cycle by subtracting the operation time in the defrosting effect interval from the defrosting timer cycle;

obtaining a normal cycle number of times of the compressor by dividing the normal defrosting timer cycle by the normal operation time;

calculating a normal run time of the compressor by summing the value obtained by multiplying the normal cycle by the normal operation time and summing the multiplied result and the normal pause time; and calculating the unit run cycle by summing the time of the defrosting effect interval and the normal operation time.

19. The power consumption prediction apparatus according to claim 18, wherein said energy consumption calculator calculates the normal run time by further summing the normal operation remaining interval being the residue which is obtained by dividing the normal defrosting timer cycle by the normal operation time.

20. The power consumption prediction apparatus according to claim 18, wherein said energy consumption calculator obtains the normal operation time by averaging the operation time of a plurality of cooling cycles during the normal interval, and obtains the normal pause time by averaging the pause time of a plurality of cooling cycles during the normal interval.

21. The power consumption prediction apparatus according to claim 17, wherein said energy consumption calculator estimates the energy consumption by performing the steps of:

setting a reference prediction unit time;

calculating a unit run energy;

calculating the energy consumed during at least one unit run cycle in whole or in part included in the reference prediction unit time based on the unit run energy; and summing the energy consumed during at least one unit run cycle in whole or in part included in the reference prediction unit time.

22. The power consumption prediction apparatus according to claim 21, wherein said reference prediction unit time is 24 hours.

23. The power consumption prediction apparatus according to claim 21, wherein said energy consumption calculator performs the steps of:

setting a plurality of prediction unit times;

comparing a sum of the unit run cycle and the defrosting effect interval with said each prediction time; and setting a prediction unit time which is right above the sum of the unit run cycle and the defrosting effect interval as a reference prediction unit time.

24. The power consumption prediction apparatus according to claim 23, wherein said plurality of prediction unit times are 24 hours, 48 hours and 72 hours.

25. The power consumption prediction apparatus according to claim 24, wherein said energy consumption calculator sets said reference prediction unit time to be 72 hours when the sum of the said unit run cycle and said defrosting effect interval exceeds 72 hours.

26. The power consumption prediction apparatus according to claim 21, wherein said energy consumption calculator calculates the unit run energy by performing the steps of:

obtaining a defrosting effect interval energy by summing the defrosting energy and the pause energy and the operation energy during the defrosting effect interval of the compressor;

obtaining a normal cycle energy by summing the normal pause energy and the normal operation energy;

calculating a normal run energy of the compressor by summing the value obtained by multiplying the normal cycle number of times by the normal cycle energy and the normal pause energy; and summing the defrosting effect interval energy and the normal run energy.

27. The power consumption prediction apparatus according to claim 26, wherein said energy consumption calculator obtains the normal pause energy by averaging the pause energy of a plurality of cooling cycles during the normal interval, and obtains the normal operation energy by averaging the operation energy of a plurality of cooling cycles during the normal interval.

28. The power consumption prediction apparatus according to claim 26, wherein said energy consumption calculator calculates the normal run energy by further summing the energy consumed during the normal operation remaining interval.

29. The power consumption prediction apparatus according to claim 26, wherein said energy consumption calculator calculates the energy consumed during the at least one unit run cycle which is included in whole or in part in the reference prediction unit time, by performing the steps of estimating whether a defrosting effect remaining interval, the defrosting effect interval is started and is not completed yet, or a normal remaining interval, the normal cycle is started and is not completed yet exists, for the reference prediction unit time based on the unit run cycle of the refrigerator, and further estimating the consumed energy during a predetermined time by further summing the energy consumed during the existing interval when the defrosting effect remaining interval or the normal remaining interval exists.

30. The power consumption prediction apparatus according to claim 29, wherein said energy consumption calculator estimates whether the defrosting effect remaining interval or the normal remaining interval exists, by estimating that the defrosting effect remaining interval exists when the remaining interval obtained by dividing the reference prediction unit time by the unit run time of the refrigerator is smaller than the defrosting effect interval, and estimates that the normal remaining interval exists when the remaining interval is larger than the defrosting effect interval.

31. The power consumption prediction apparatus according to claim 29, wherein said energy consumption calculator calculates the energy consumed during the defrosting effect remaining interval based on the defrosting effect interval energy when the defrosting effect remaining interval exists.

32. The power consumption prediction apparatus according to claim 29, wherein said energy consumption calculator calculates the energy consumed during the normal remaining interval based on the normal cycle energy when the normal remaining interval exists.

* * * * *